US006397591B1

(12) United States Patent
Tsuruga et al.

(10) Patent No.: US 6,397,591 B1
(45) Date of Patent: Jun. 4, 2002

(54) HYDRAULIC DRIVING UNIT

(75) Inventors: Yasutaka Tsuruga, Ryugasaki; Takashi Kanai, Kashiwa; Junya Kawamoto, Tsuchiura; Kenichiro Nakatani, Tsuchiura; Kiwamu Takahashi, Tsuchiura; Satoshi Hamamoto, Toyama-ken; Yasuharu Okazaki, Takaoka; Yukiaki Nagao, Toyama, all of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/601,518

(22) PCT Filed: Dec. 2, 1999

(86) PCT No.: PCT/JP99/06763

§ 371 (c)(1),
(2), (4) Date: Aug. 2, 2000

(87) PCT Pub. No.: WO00/32942

PCT Pub. Date: Jun. 8, 2000

(30) Foreign Application Priority Data

Dec. 3, 1998 (JP) ..... 10-344134

(51) Int. Cl.[7] ..... F15B 13/06
(52) U.S. Cl. ..... 60/422; 91/516; 91/446
(58) Field of Search ..... 60/420, 469, 422; 91/516, 446

(56) References Cited

U.S. PATENT DOCUMENTS 4,617,854 A 10/1986 Kropp ..... 60/422
5,937,645 A * 8/1999 Hamamoto ..... 60/422

FOREIGN PATENT DOCUMENTS

| | | |
|---|---|---|
| JP | 57-106909 | 7/1982 |
| JP | 60-11706 | 1/1985 |
| JP | 4-248002 | 9/1992 |
| JP | 5-33774 | 2/1993 |
| JP | 10-37907 | 2/1998 |
| JP | 10-89304 | 4/1998 |

* cited by examiner

*Primary Examiner*—Edward K. Look
*Assistant Examiner*—Thomas E. Lazo
(74) *Attorney, Agent, or Firm*—Mattingly, Stanger & Malur, P.C.

(57) ABSTRACT

A hydraulic drive system includes a pump control unit 18 for controlling a pump delivery rate such that a pump delivery pressure is held at a predetermined value higher than a maximum load pressure among actuators 2–6. Pressure compensating valves 12–16 are each constructed to set, as a target compensation differential pressure, a differential pressure between the delivery pressure of a hydraulic pump 1 and the maximum load pressure among the actuators 2–6. The pressure compensating valve 12 is given such a load dependent characteristic that the target compensation differential pressure is reduced when a load pressure rises. A lower limit setting spring 55 for limiting the target compensation differential pressure from becoming smaller than a predetermined value is provided in the pressure compensating valve 12 for the swing section.

8 Claims, 16 Drawing Sheets

HYDRAULIC DRIVING UNIT

TECHNICAL FIELD

The present invention relates to a hydraulic drive system for a construction machine including a swing control system, such as a hydraulic excavator. More particularly, the present invention relates to a hydraulic drive system wherein, when a hydraulic fluid from a hydraulic pump is supplied to a plurality of actuators, including a swing motor, through respective associated directional control valves, a delivery rate of the hydraulic pump is controlled by a load sensing system and differential pressures across the directional control valves are controlled by respective associated pressure compensating valves.

BACKGROUND ART

JP, A, 60-11706 discloses a hydraulic drive system for controlling a delivery rate of a hydraulic pump by a load sensing system (hereinafter referred to also as an LS system). Also, JP, A, 10-37907 discloses a hydraulic drive system for a construction machine including a swing control system, the hydraulic drive system including an LS system and being intended to realize independence and operability of the swing control system. A 3-pump system mounted on an actual machine is also disclosed as an open-center hydraulic drive system for a construction machine including a swing control system, the hydraulic drive system being intended to realize independence of the swing control system. Further, JP, A, 10-89304 discloses a hydraulic drive system wherein a delivery rate of a hydraulic pump is controlled by an LS system and a pressure compensating valve is given a load dependent characteristic.

In the hydraulic drive system disclosed in JP, A, 60-11706, a plurality of pressure compensating valves each include means for setting, as a target compensation differential pressure, a differential pressure between a delivery pressure of the hydraulic pump and a maximum load pressure among a plurality of actuators. In the combined operation where a plurality of actuators are simultaneously driven, there occurs a saturation state that the delivery rate of the hydraulic pump is not enough to supply flow rates demanded by a plurality of directional control valves. In such a saturation state, the differential pressure between the delivery pressure of the hydraulic pump and the maximum load pressure is lowered, and correspondingly the target compensation differential pressure of each pressure compensating valve is reduced. As a result, the delivery rate of the hydraulic pump can be redistributed in accordance with a ratio between the respective flow rates demanded by the actuators.

In the hydraulic drive system disclosed in JP, A, 10-37907 and the 3-pump system mounted on an actual machine, an independent open-center circuit using an independent hydraulic pump is constructed for a swing section, which includes a swing motor, separately from a circuit for the other actuators, whereby independence and operability of the swing control system is ensured.

In the hydraulic drive system disclosed in JP, A, 10-89304, a plurality of pressure compensating valves each have hydraulic pressure chambers constructed as follows. A pressure bearing area of a hydraulic pressure chamber, to which an input side pressure of a directional control valve is introduced and which produces a force acting in the valve-closing direction, is set to be greater than a pressure bearing area of a hydraulic pressure chamber, to which an output side pressure of the directional control valve is introduced and which produces a force acting in the valve-opening direction. The pressure compensating valve is thereby given such a load dependent characteristic that, as a load pressure of each associated actuator rises, the target compensation differential pressure of the pressure compensating valve is reduced (i.e., the pressure compensating valve is throttled) to decrease a supply flow rate to the actuator. As a result, the actuators on both the lower and higher load sides can be operated with good operability in a stable manner without hunting.

DISCLOSURE OF THE INVENTION

The conventional hydraulic drive systems described above however have the following problems with the swing control system.

JP, A, 60-11706: problems ① and ②

JP, A, 10-89304: problems ② and ③

JP, A, 10-37907: problem ④

Open-center 3-pump system mounted on actual machine: problem ④

① jerky feel in operation at start-up of swing alone

② change of the swing speed at shift from operation of swing alone to combined operation including swing and vice versa.

③ extreme drop of the swing speed at start-up of combined operation including swing ④ increase in cost and space and complicated circuit configuration due to provision of a separate circuit (1) JP, A, 60-11706

When the hydraulic drive system including the LS system, disclosed in JP, A, 60-11706, is applied to the swing control system, it is difficult to keep balance between load sensing control (hereinafter referred to also as LS control) of the hydraulic pump and a flow rate compensating function of the pressure compensating valve due to an inertial load of the swing control system. This is because a difficulty occurs in keeping balance between response of the pressure compensating valve and response in the LS control of the hydraulic pump due to the following reasons when a swing driving pressure is controlled in a stage of shift from swing acceleration to steady rotation.

(1) In a swing start-up and acceleration mode, the pump LS control is performed so as to raise a delivery pressure of the hydraulic pump depending on the swing start-up pressure for holding a constant flow rate.

(2) To hold constant a differential pressure across a throttling element of the directional control valve, the pressure compensating valve is operated in a direction to increase a flow rate passing itself that tends to reduce upon a rise of the load pressure.

(3) When the swing reaches a steady speed, the swing driving pressure is lowered and therefore the pump LS control is not required to control the delivery pressure of the hydraulic pump so high as in the swing start-up and acceleration mode. Hence the pump LS control is performed in a direction to lower the delivery pressure of the hydraulic pump.

(4) Upon a lowering of the swing driving pressure, the pressure compensating valve is operated in a direction to reduce the flow rate passing itself that tends to increase.

Because of quick shift from (1) to (4), the swing operation becomes jerky (above problem ①).

In the combined operation, as described above, there occurs a saturation state that the delivery rate of the hydraulic pump is not enough to supply flow rates demanded by a plurality of directional control valves. Corresponding to such a saturation state, the target compensation differential pressure of each pressure compensating valve is reduced, and the delivery rate of the hydraulic pump is redistributed in accordance with a ratio between the respective flow rates demanded by the actuators. With that function, even in the combined operation, the actuators are operated, although slightly slowed down, by the hydraulic fluid distributed at the ratio depending on the intended operations, whereby a feel in the operation is not impaired.

However, such slowdown likewise occurs in the swing operation, and during the combined operation including swing, the swing speed is also reduced as with one or more other actuators. This slowdown gives rise to change of the swing speed at shift from the swing-combined operation to the swing-alone operation and vice versa, thus causing the operator to feel awkward (above problem ②).

(2) JP, A, 10-89304

In the hydraulic drive system disclosed in JP, A, 10-89304, since the pressure compensating valve is given a load dependent characteristic, the target compensation differential pressure of the pressure compensating valve is reduced in response to a rise of the load pressure of the swing motor at the start-up of swing alone, and when the swing motor shifts to a steady sate, the target compensation differential pressure of the pressure compensating valve is also returned to the original value in response to a lowering of the load pressure of the swing motor. As a result, the swing can be started up without causing a jerky feel in operation. However, when the delivery rate of the hydraulic pump comes into a saturation state in the combined operation, the delivery rate of the hydraulic pump is redistributed in accordance with a ratio between the respective flow rates demanded by the directional control valves, as with the hydraulic drive system disclosed in JP, A, 60-11706. Accordingly, the swing speed is changed at shift from the swing-combined operation to the swing-alone operation and vice versa, thus causing the operator to feel awkward (above problem ②).

Further, since the pressure compensating valve is given a load dependent characteristic, the target compensation differential pressure of the pressure compensating valve for the swing section is reduced depending on the condition of the delivery rate of the hydraulic pump at the start-up of the swing-combined operation. In addition, the target compensation differential pressure is also reduced due to the load dependent characteristic as the load pressure of the swing motor rises up to a relief pressure. Such a reduction in the target compensation differential pressure continues until the swing motor shifts to the steady sate. As a result, the swing speed is extremely lowered as compared with the speeds of other actuators at the start-up of the swing-combined operation, whereby swing operability at the start-up of the swing-combined operation is deteriorated (above problem ③).

(3) Hydraulic Drive System Disclosed in JP, A, 10-37907 and Open-center 3-Pump System Mounted on Actual Machine In the hydraulic drive system disclosed in JP, A, 10-37907, the swing control system is constructed by a separate open-center circuit to ensure satisfactory swing operability in the LS system. Also, in the open-center 3-pump system mounted on an actual machine, the swing control system is constructed as a separate open-center circuit to ensure satisfactory swing operability.

More specifically, in the open-center system, when the driving pressure rises at the swing start-up, a flow rate of the hydraulic fluid returning to a reservoir through a center bypass fluid line is increased, which reduces a flow rate of the hydraulic fluid passing a throttle of the directional control valve for the swing section. A flow rate of the hydraulic fluid supplied to the swing motor is therefore restricted in the swing start-up and acceleration mode. When the swing speed reaches a steady speed, no restriction is imposed on the supply flow rate to the swing motor because of the driving pressure being not so high as at the swing start-up, and the hydraulic fluid is supplied to the swing motor at a flow rate corresponding to an opening of the throttle of the directional control valve for the swing section. The swing can be thereby smoothly started up without causing a jerky feel in operation for starting up the swing solely unlike the LS control.

Although the above problem ② occurs in not only the LS system but also the open-center system, change of the swing speed is not caused in the hydraulic drive system and the open-center 3-pump system mounted on an actual machine, which are disclosed in JP, A, 10-37907, because the swing control system is constructed as the separate open-center circuit and independence of the swing control system is realized.

However, in the hydraulic drive system disclosed in JP, A, 10-37907 and the 3-pump system mounted on an actual machine, the swing control system must be constructed as a separate circuit in parallel to the system for the other actuators. Correspondingly, a cost is pushed up and a space required for installation is increased. In addition, a hydraulic pump for the swing control system must be separately provided. In the system disclosed in JP, A, 10-37907, particularly, a signal line is required to keep power balance between the swing control system and the LS system which are arranged in parallel, and hence the circuit configuration is complicated (problem ④).

An object of the present invention is to provide a hydraulic drive system including a swing control system, which enables swing operation to be accelerated for shift to a steady state without causing a jerky feel at the start-up of swing alone and combined operation including swing, which can suppress change of the swing speed at shift from the swing-alone operation to the swing-combined operation and vice versa, which can avoid the swing speed from extremely reducing as compared with the speeds of one or more other actuators at the start-up of the swing-combined operation, thereby ensuring superior swing operability and swing independence, and which is free from problems resulted from providing a separate circuit, such as an increase in cost and space and complication of the circuit configuration.

(1) To achieve the above object, the present invention provides a hydraulic drive system comprising a hydraulic pump, a plurality of actuators, including a swing motor, which are driven by a hydraulic fluid delivered from the hydraulic pump, a plurality of directional control valves for controlling respective flow rates of the hydraulic fluid supplied from the hydraulic pump to the plurality of actuators, a plurality of pressure compensating valves for controlling respective differential pressures across the plurality of directional control valves, and pump control means for load sensing control to control a pump delivery rate such that a delivery pressure of the hydraulic pump is held a predetermined value higher than a maximum load pressure among the plurality of actuators, wherein the hydraulic drive system further comprises first means provided respectively in those of the plurality of pressure compensating valves, which are not for a swing section associated with the swing motor, and setting, as a target compensation differential pressure, a differential pressure between the delivery pressure of the hydraulic pump and the maximum load pressure among the plurality of actuators; second means provided in the pressure compensating valve for the swing section and setting a target compensation differential pressure of that pressure compensating valve; third means provided in at least one of the plurality of pressure compensating valves, which is for the swing section, and reducing the target compensation differential pressure set by the second means when a load pressure of the swing motor rises, thereby giving a load dependent characteristic to the pressure compensating valve for the swing section; and fourth means provided in the pressure compensating valve for the swing section and setting a lower limit of the target compensation differential pressure that is set by the second means and modified by the third means.

With the present invention thus constructed, since the third means is provided in the pressure compensating valve for the swing section to give it the load dependent characteristic, the pressure compensating valve for the swing section finely adjusts the flow rate passing the same depending on change in the load pressure of the swing motor at the swing start-up, whereby the swing motor is smoothly accelerated and shifted to the steady state.

Also, the second means for setting the target compensation differential pressure of the pressure compensating valve for the swing section may be means for setting, as the target compensation differential pressure, the differential pressure between the delivery pressure of the hydraulic pump and the maximum load pressure among the plurality of actuators as with the first means. In this case, by providing the fourth means as set forth above, the fourth means functions as lower limit setting means for limiting both reduction in the target compensation differential pressure itself set by the second means and reduction in the target compensation differential pressure due to the load dependent characteristic given by the third means (see (2) below). With this function, when the target compensation differential pressure of the pressure compensating valve for the swing section is going to reduce upon the delivery rate of the hydraulic pump coming into the saturation state, or when the target compensation differential pressure of the pressure compensating valve for the swing section is going to reduce in accordance with the load dependent characteristic upon a rise of the load pressure of the hydraulic pump, or when both of the above phenomena occur at the same time, the fourth means limits the reduction of the target compensation differential pressure so that the hydraulic fluid is supplied to the swing motor with priority. As a result, change of the swing speed is suppressed at shift from the swing-alone operation to the swing-combined operation, and vice versa. Further, at the start-up of the swing-combined operation, the swing speed is prevented from being extremely slowed down as compared with the speed of another actuator, whereby superior swing operability and swing independence can be ensured.

The second means for setting the target compensation differential pressure of the pressure compensating valve for the swing section may be means for setting, as the target compensation differential pressure, a value not changed depending on the differential pressure between the delivery pressure of the hydraulic pump and the maximum load pressure among the plurality of actuators. In this case, the fourth means functions as lower limit setting means for limiting reduction in the target compensation differential pressure due to the load dependent characteristic given by the third means (see (3) below). With this function, even when the delivery rate of the hydraulic pump comes into the saturation state, the target compensation differential pressure of the pressure compensating valve for the swing section is not reduced. Also, when the target compensation differential pressure of the pressure compensating valve for the swing section is going to reduce in accordance with the load dependent characteristic upon a rise of the load pressure of the hydraulic pump, the fourth means limits the reduction in the target compensation differential pressure. Thus, even when the reductions in the target compensation differential pressure due to the saturation and the load dependent characteristic occur solely or simultaneously, the hydraulic fluid is supplied to the swing motor with priority. As a result, change of the swing speed is suppressed at shift from the swing-alone operation to the swing-combined operation, and vice versa. Further, at the start-up of the swing-combined operation, the swing speed is prevented from being extremely slowed down as compared with the speed of another actuator, whereby superior swing operability and swing independence can be ensured.

Additionally, since the above-described functions are achieved without providing a separate circuit, such problems as an increase in cost and space and complication of the circuit configuration are avoided.

(2) In the above (1), preferably, the second means is means for setting, as the target compensation differential pressure, the differential pressure between the delivery pressure of the hydraulic pump and the maximum load pressure among the plurality of actuators as with the first means, and the fourth means functions as lower limit setting means for limiting both reduction in the target compensation differential pressure itself set by the second means and reduction in the target compensation differential pressure due to the load dependent characteristic given by the third means.

With that feature, as set forth in the above (1), when the target compensation differential pressure of the pressure compensating valve for the swing section is going to reduce upon the delivery rate of the hydraulic pump coming into the saturation state, or when the target compensation differential pressure of the pressure compensating valve for the swing section is going to reduce in accordance with the load dependent characteristic upon a rise of the load pressure of the hydraulic pump, or when both of the above phenomena occur at the same time, the fourth means limits the reduction of the target compensation differential pressure so that the hydraulic fluid is supplied to the swing motor with priority, whereby superior swing operability and swing independence can be ensured.

(3) In the above (1), the second means may be means for setting, as the target compensation differential pressure, a value not changed depending on the differential pressure between the delivery pressure of the hydraulic pump and the maximum load pressure among the plurality of actuators. In this case, the fourth means functions as lower limit setting means for limiting the reduction in the target compensation differential pressure due to the load dependent characteristic given by the third means.

With that feature, as set forth in the above (1), even when the delivery rate of the hydraulic pump comes into the saturation state, the target compensation differential pressure of the pressure compensating valve for the swing section is not reduced. Also, when the target compensation differential pressure of the pressure compensating valve for the swing section is going to reduce in accordance with the load dependent characteristic upon a rise of the load pressure of the hydraulic pump, the fourth means limits the reduction in the target compensation differential pressure. Thus, even when the reductions in the target compensation differential pressure due to the saturation and the load dependent characteristic occur solely or simultaneously, the hydraulic fluid is supplied to the swing motor with priority, whereby superior swing operability and swing independence can be ensured.

(4) In the above (1)–(3), preferably, the fourth means is biasing means for applying a biasing force to a spool of the pressure compensating valve for the swing section in the valve-opening direction when the target compensation differential pressure set by the second means and modified by the third means reaches a predetermined value.

With that feature, the fourth means prevents the target compensation differential pressure of the pressure compensating valve for the swing section from reducing down below a value corresponding to the biasing force applied by the biasing means.

(5) In the above (4), preferably, the biasing means is a lower limit setting spring acting on the spool of the pressure compensating valve for the swing section and biasing the spool in the valve-opening direction when the target compensation differential pressure set by the second means and modified by the third means reaches the predetermined value.

With that feature, the biasing means applies the biasing force to the spool of the pressure compensating valve for the swing section in the valve-opening direction when the target compensation differential pressure of the pressure compensating valve for the swing section reaches the predetermined value.

(6) In the above (1) and (2), preferably, the fourth means is biasing means for always adding a supplement value to the target compensation differential pressure that is set by the second means and modified by the third means, and the directional control valve for the swing section is constructed such that meter-in variable throttles thereof each have an opening area smaller than that in the directional control valves not for the swing section by an amount of the target compensation differential pressure corresponding to the supplement value added by the biasing means.

With that feature, the fourth means restricts the reduction in the target compensation differential pressure of the pressure compensating valve for the swing section by an amount corresponding to the supplement value added by the biasing means, thereby setting a lower limit of the target compensation differential pressure.

(7) In the above (6), preferably, the biasing means is a swing priority spring always acting on the spool of the pressure compensating valve for the swing section in the valve-opening direction.

With that feature, the fourth means always adds the supplement value to the target compensation differential pressure of the pressure compensating valve for the swing section.

BEST MODE FOR CARRYING OUT THE INVENTION

Embodiments of the present invention will be described below with reference to the drawings.

Figure 1:
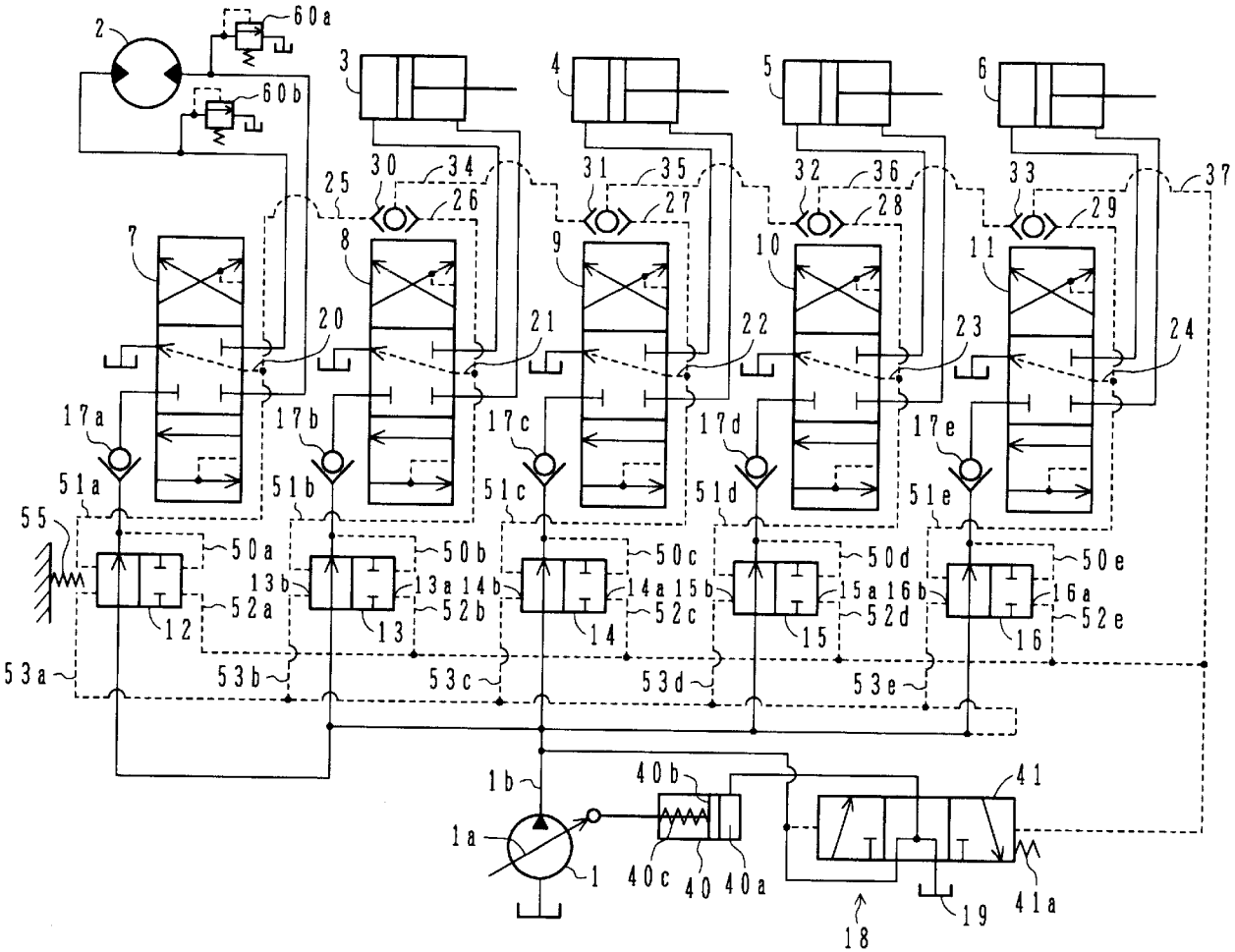
FIG. 1 is a circuit diagram showing a hydraulic drive system according to a first embodiment of the present invention.

FIG. 1 shows a hydraulic drive system according to a first embodiment of the present invention. The hydraulic drive system comprises a hydraulic pump 1, a plurality of actuators 2–6, including a swing motor 2, which are driven by a hydraulic fluid delivered from the hydraulic pump 1, a plurality of closed-center directional control valves 7–11 for controlling respective flow rates of the hydraulic fluid supplied from the hydraulic pump 1 to the plurality of actuators 2–6, a plurality of pressure compensating valves 12–16 for controlling respective differential pressures across the plurality of directional control valves 7–11, load check valves 17*a*–17*e* disposed respectively between the directional control valves 7–11 and the pressure compensating valves 12–16 to prevent reverse flow of the hydraulic fluid, and a pump control delivery rate such that a delivery pressure of the hydraulic pump 1 is held a predetermined value higher than a maximum load pressure among the plurality of actuators 2–6. Overload relief valves 60*a*, 60*b* are provided in an actuator line for the swing motor 2. Though not shown, similar overload relief valves are provided in association with the other actuators 3–6.

The plurality of directional control valves 7–11 are provided with lines 20–24 respectively for detecting load pressures of themselves. A maximum one of load pressures detected with the detection lines 20–24 is extracted and introduced to a signal line 37 through signal lines 25–29, shuttle valves 30–33 and signal lines 34–36.

The pump control unit 18 comprises a tilting control actuator 40 coupled to a swash plate 1*a* which serves as a displacement varying member of the hydraulic pump 1, and a load sensing control valve (hereinafter referred to also as an LS control valve) for selectively controlling connection of a hydraulic pressure chamber 40*a* of the actuator 40 to a delivery fluid line 1*b* of the hydraulic pump 1 and a reservoir 19. The delivery pressure of the hydraulic pump 1 and the maximum load pressure in the signal line 37 act, as control pressures, on the LS control valve in opposite directions. When the pump delivery pressure rises beyond a total of the maximum load pressure and a setting value (target LS differential pressure) of a spring 41*a*, the hydraulic pressure chamber 40*a* of the actuator 40 is connected to the delivery fluid line 1*b* of the hydraulic pump 1 and a higher pressure is introduced to the hydraulic pressure chamber 40*a*, whereupon the piston 40*b* is moved to the left in FIG. 1 against the force of a spring 40*c*. Accordingly, the tilting of the swash plate 1*a* is decreased to reduce the delivery rate of the hydraulic pump 1. Conversely, when the pump delivery pressure lowers down below the total of the maximum load pressure and the setting value (target LS differential pressure) of the spring 41*a*, the hydraulic pressure chamber 40*a* of the actuator 40 is connected to the reservoir 19 and the hydraulic pressure chamber 40*a* is depressurized, whereupon the piston 40*b* is moved to the right in FIG. 1 by the force of the spring 40*c*. Accordingly, the tilting of the swash plate 1*a* is enlarged to increase the delivery rate of the hydraulic pump 1. With the above-described operation of the LS control valve, the delivery rate of the hydraulic pump 1 is controlled such that the pump delivery pressure is held higher than the maximum load pressure by an amount corresponding to the setting value (target LS differential pressure) of the spring 41*a*.

In the pressure compensating valves 12–16, pressures upstream of the directional control valves 7–11 act in the valve-closing direction, pressures (load pressures) in the detection lines 20–24 given by pressures downstream of the directional control valves 7–11 act in the valve-opening direction, the maximum load pressure introduced to the signal line 37 acts in the valve-closing direction, and the delivery pressure of the hydraulic pump 1 acts in the valve-opening direction. As a result, the differential pressures across the plurality of directional control valves 7–11 are controlled by employing, as the target compensation differential pressure, a differential pressure (hereinafter referred to also as an LS control differential pressure) between the delivery pressure of the hydraulic pump 1, which has been LS-controlled as described above, and the maximum load pressure.

Of the pressures acting on the pressure compensating valves 12–16, the pressures upstream of the directional control valves 7–11 are taken out respectively through signal lines 50*a*–50*e*, the pressures (load pressures) in the detection lines 20–24 given by the pressures downstream of the directional control valves 7–11 are taken out respectively through signal lines 51*a*–51*e*, the maximum load pressure in the signal line 37 is taken out through signal lines 52 and 52*a*–52*e*, and the delivery pressure of the hydraulic pump 1 is taken out through signal lines 53 and 53*a*–53*e*. In the pressure compensating valves 13–16, the maximum load pressure taken out through the signal lines 52*b*–52*e* is applied to fluid chamber 13*a*–16*a*, and the delivery pressure of the hydraulic pump 1 taken out through the signal lines 53*b*–53*e* is applied to fluid chamber 13*b*–16*b*, thereby setting the target compensation differential pressure. Fluid chambers of the pressure compensating valve 12, which are formed therein to set the target compensation differential pressure, will be described later.

Further, the pressure compensating valve 12 is constructed to have such a load dependent characteristic that when the load pressure of the swing motor 2 rises under a condition where the pressure upstream of the directional control valve 7 acts in the valve-closing direction and the pressure (the load pressure of the swing motor 2 ) in the detection line 20 given by the pressure downstream of the directional control valve 7 acts in the valve-opening direction, the target compensation differential pressure is reduced to restrict the flow rate of the hydraulic fluid passing the directional control valve 7. In addition, the pressure compensating valve 12 includes a lower-limit setting spring 55 provided on the side acting in the valve-opening direction, i.e., on the side setting the target compensation differential pressure. The lower-limit setting spring 55 acts on a spool of the pressure compensating valve 12 only when the target compensation differential pressure of the pressure compensating valves 13–16 for the other sections is reduced down below the setting value of the spring 55, thereby setting a lower limit to prevent the target compensation differential pressure from becoming smaller than the setting value.

Figure 2:
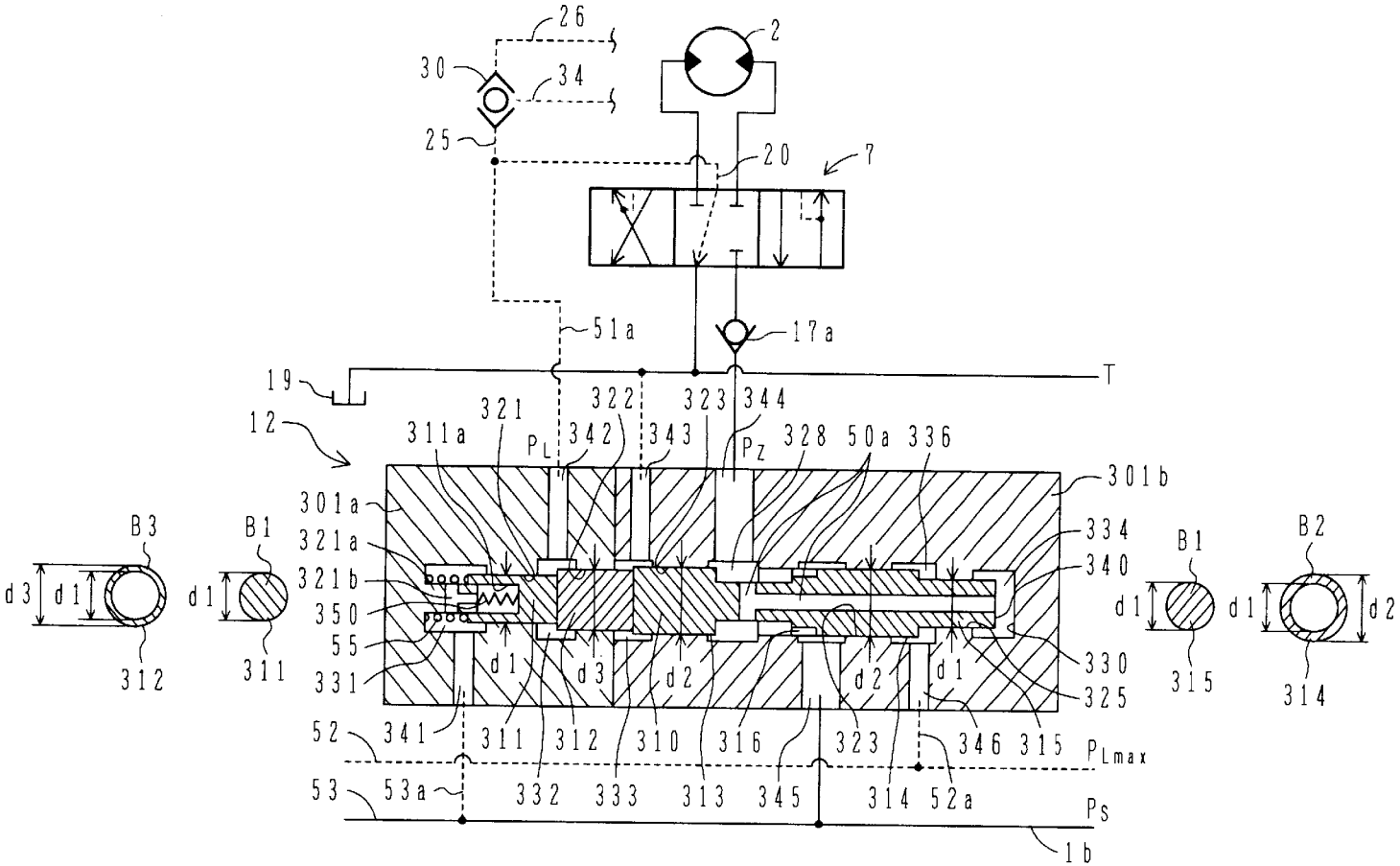
FIG. 2 is a sectional view showing details of the structure of a pressure compensating valve for a swing section.

The structure of the pressure compensating valve 12 is shown in FIG. 2.

Referring to FIG. 2, the pressure compensating valve 12 has two bodies 101, i.e., a first body 301*a* and a second body 301*b*. These bodies are assembled into an integral structure by appropriate means (not shown) such as bolting. In the first body 301*a*, there are formed a small-diameter bore 321 and a medium-diameter bore 322 in continuation to the small-diameter bore 321. A first spool 311 having a diameter d1 is slidably fitted in the small-diameter bore 321, and a second spool 312 having a diameter d3 (>d1) is slidably fitted in a medium-diameter bore 322. In the second body 301*b*, there are formed a large-diameter bore 323 in continuation to the medium-diameter bore 322 and a small-diameter bore 325 which is in continuation to the large-diameter bore 323 and has the same diameter as the small-diameter bore 321. A third spool 310 is slidably fitted in the large-diameter bore 323 and the small-diameter bore 325. The third spool 310 has first and second large-diameter portions 313, 314 which are slidably fitted in the large-diameter bore 323 and have a diameter d2 (>d3), and a small-diameter portion 315 which is slidably fitted in the small-diameter bore 325 and has the diameter d1.

A projection 321*a* is provided at an end surface of the small-diameter bore 321, and a fluid chamber 331 is formed around the projection 321*a*. A recess 311*a* for receiving the projection 321*a* is formed in an end surface of the first spool 311, and a weak initial-position holding spring 350 for pushing the spools in the valve-opening direction is disposed between an end surface of the projection 321*a* and a bottom portion of the recess 311*a*. Also, a chamber in which the spring 350 is disposed is communicated with the oil chamber 331, positioned on the outer side, through a passage 321*b* formed in the projection 321*a*.

The lower-limit setting spring 55 is disposed over the projection 321 in the oil chamber 331 and is positioned to face the end surface of the first spool 311. In the initial position as shown, the lower-limit setting spring 55 is positioned to face the end surface of the first spool 311, but away from the same, thereby generating no force to push the spools in the valve-closing direction.

Further, a pump port 341 and a load pressure port 342 are formed in the body 301*a*, while a reservoir port 343, an output port 344, an input port 345 and a maximum load pressure port 346 are formed in the body 301*b*. The pump port 341 is communicated with the signal line 53*a* for the delivery pressure of the hydraulic pump 1 and is opened to the fluid chamber 331. The load pressure port 342 is communicated with the load-pressure signal line 51*a* and is opened to a fluid chamber 332 which is formed in a connecting portion between the small-diameter bore 321 and the medium-diameter bore 322. Further, the reservoir port 343 is communicated with the reservoir 19 and is opened to a fluid chamber 333 formed in the large-diameter bore 323 which surrounds abutting ends of the second spool 312 and the third spool 310. The output port 344 is connected to the load check valve 17*a* and is opened to a fluid chamber 328 formed in the large-diameter bore 323 between the first and second large-diameter portions 313, 314 of the third spool. The input port 345 is communicated with the pump delivery fluid line 1*b* and is opened to the input side of a throttle portion 316 which is capable of opening/closing and formed in the second large-diameter portion 314 of the third spool 310. The maximum load pressure port 346 is communicated with the signal line 52*a* for the maximum load pressure and is opened to a fluid chamber 336 formed in the large-diameter bore 323 in which a continuously stepped portion between the second large-diameter portion 314 and the small-diameter portion 315 of the third spool 310.

Additionally, between the small-diameter portion 315 and an end surface 330 of the small-diameter bore, there is formed a fluid chamber 334 communicating with the fluid chamber 328, to which the output port 344 is opened, through a pilot fluid passage 50*a* formed within the third spool 310.

The body 301 is constructed by assembling the first body 301*a* and the second body 301*b* into an integral structure by appropriate means (not shown) such as bolting. At that time, even if the medium-diameter bore 322 on the side of the first body 301*a* and the large-diameter bore 323 on the side of the second body 301*b* are offset from each other, there is no problem in operation because the second spool 312 and the third spool 310 are formed as separate parts and held just in an abutting relation.

With the above construction, in the closing direction of the pressure compensating valve 12, the output pressure (Pz) at the output port 34 acts on a pressure bearing area B1 of the end surface 340 of the small-diameter portion 315 in the fluid chamber 334 through the pilot fluid passage 50*a*, and the maximum load pressure (PLmax) at the maximum load pressure port 346 acts on a pressure bearing area B2 of the stepped portion in the fluid chamber 336, which is resulted from subtracting the cross-sectional area of the small-diameter portion 315 from the cross-sectional area of the second large-diameter portion 314. Also, in the opening direction of the pressure compensating valve 12, the pump delivery pressure (Ps) acts on a pressure bearing area B1 of the end surface 340 of the first spool 311 in the fluid chamber 331 through the pump port 341, and the load pressure (PL) at the load pressure port 342 acts on a pressure bearing area B3 of the stepped portion in the fluid chamber 332, which is resulted from subtracting the cross-sectional area B1 of the first spool 311 from the cross-sectional area of the second spool 312. Moreover, no force acting to open and close the spools is imposed on a pressure bearing area of the stepped portion in the fluid chamber 333, which is resulted from subtracting the cross-sectional area of the second spool 312 from the cross-sectional area of the first large-diameter portion 313, because the fluid chamber 33 is communicated with the reservoir 19 through the reservoir port 343.

Then, the pressure bearing area B2 and the pressure bearing area B1 of the first spool 311 are set substantially equal to each other (B1=B2), and in addition the pressure bearing area B3 is set to be smaller than the pressure bearing area B1 (=B2) of the first spool (B1>B3), whereby the pressure compensating valve 12 is given a load dependent characteristic under which as the load pressure (PL) of the swing motor 2 increases, the flow rate passing the directional control valve 7 communicating with the swing motor 2 is reduced.

More specifically, considering balance among the hydraulic pressures imposed on the first spool 311, the second spool 312 and the third spool 313, the following formula holds because the pressure compensating valve 12 functions under a condition where B1P−B2PLmax is balanced by B1Pz−B3PL:

$$B1Ps-B2PL\max=B1Pz-B3PL$$

From B1=B2:

$$B1(Ps-PL\max)=B2Pz-B3PL$$

Ps−PLmax represents the differential pressure (LS control differential pressure) between the delivery pressure Ps of the hydraulic pump 1, which has been LS-controlled, and the maximum load pressure PLmax. Assuming the LS control differential pressure to be ΔPc, the following formula (1) is resulted:

$$B1\Delta Pc=B2Pz-B3PL \tag{1}$$

Assuming the differential pressure across the directional control valve 7 to be ΔP, $$\Delta P=Pz-PL$$

is obtained. Also, the formula (1) can be modified into:

$$B1\Delta Pc+(B3-B2)PL=B2(Pz-PL)$$

Accordingly:

$$\Delta P = Pz - PL \tag{2}$$

$$= (B1/B2)\Delta Pc - (1-(B3/B2))PL$$

Here, by putting B1/B2=Δ and B3/B2=β:

$$\Delta P=Pz-PL=\alpha\Delta Pc-(1-\beta)PL \tag{3}$$

Stated otherwise, if B2=B3 holds (there is no area difference between B2 and B3), $\Delta P = \alpha \Delta Pc$ would be resulted and P would be determined only depending on ΔPc (LS control differential pressure). Because of B2≠B3 (area difference between B2 and B3), ΔP is affected by the load pressure PL depending on the area difference, thereby providing such a load dependent characteristic that as the load pressure PL increases, ΔP is decreased to reduce the flow rate passing the directional control valve 7.

Figure 3:
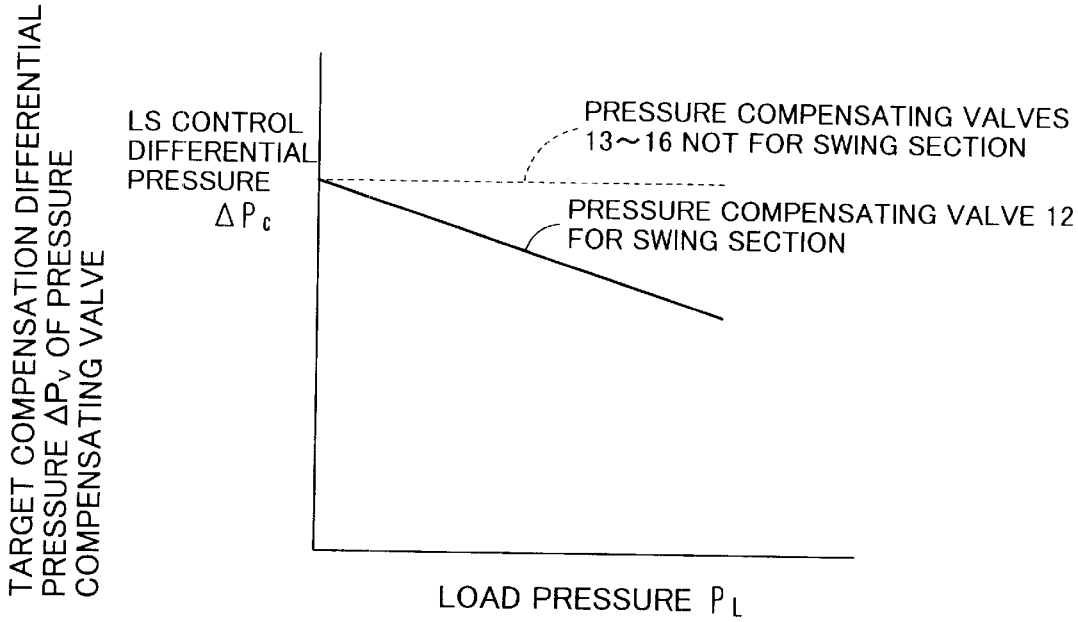
FIG. 3 is a graph showing a load dependent characteristic of the pressure compensating valve for the swing section.

FIG. 3 shows the load dependent characteristic of the pressure compensating valve 12. The horizontal axis of FIG. 3 represents the load pressure denoted by PL, and the vertical axis represents the target compensation differential pressure denoted by ΔPv. A dotted line indicates, for reference, the target compensation differential pressure of the pressure compensating valves 13–16 for sections other than that for the swing (hereinafter referred to as a swing section). The pressure compensating valves 13–16 not for the swing section each have the target compensation differential pressure ΔPv that is held at the LS control differential pressure ΔPc in spite of an increase in the load pressures PL of the associated actuators 3–6. On the other hand, in the pressure compensating valve 12 for the swing section, when the load pressures PL increases, the target compensation differential pressure ΔPv is reduced depending on an increase in the load pressure PL.

Figure 4:
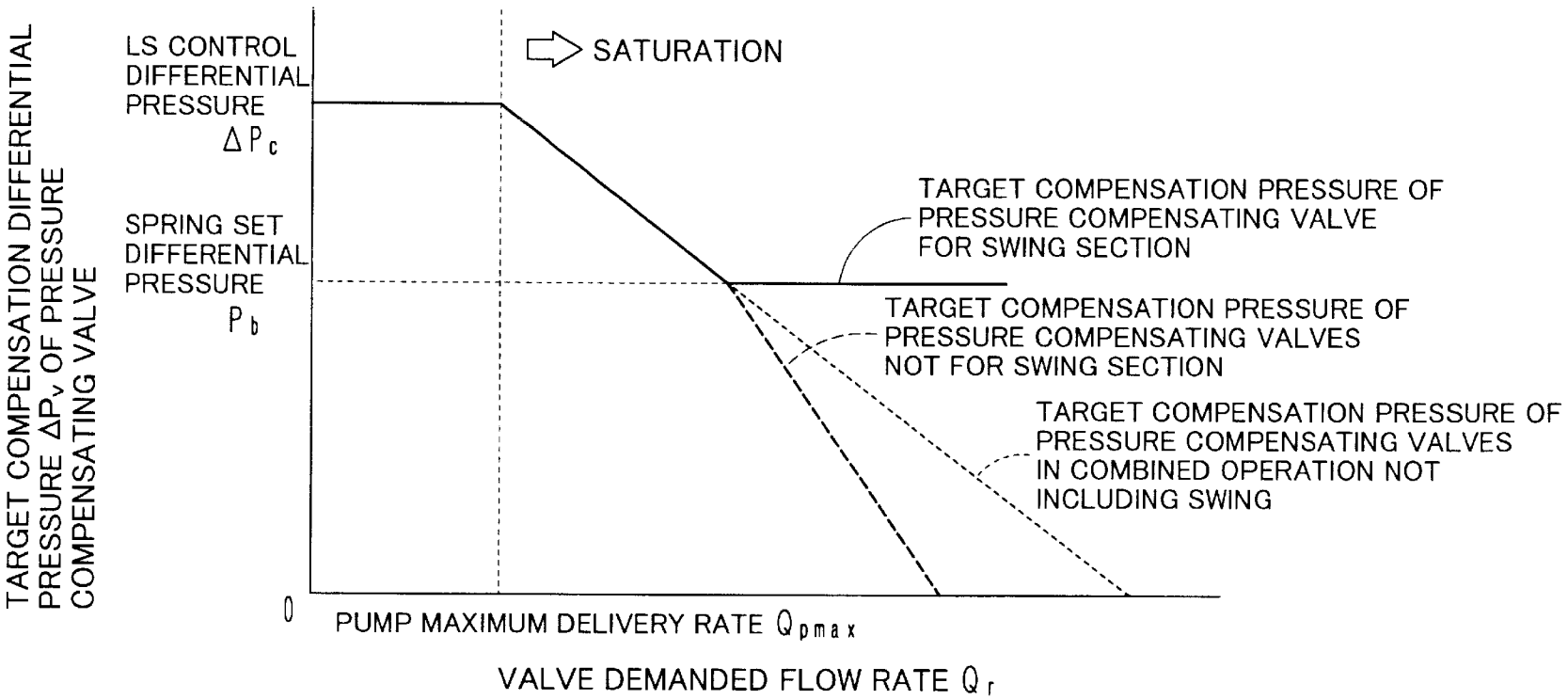
FIG. 4 is a graph showing a function of setting a lower limit of a target compensation differential pressure performed by a swing priority spring in the pressure compensating valve for the swing section.

FIG. 4 shows a function of setting a lower limit of the target compensation differential pressure effected by the lower limit setting spring 55 when it is assumed that the pressure compensating valve 12 is not given the load dependent characteristic. The horizontal axis of FIG. 4 represents, by Qr, a total of the flow rates demanded by the directional control valve 7 and the other directional control valves 8–11 (i.e., the valve demanded flow rates). This value corresponds to a total of input amounts by which levers of control lever units (not shown) for shifting the directional control valves 7–11 are operated, i.e., a total demanded flow rate of the swing motor 2 and the actuators. The vertical axis represents the target compensation differential pressure ΔPv set for the pressure compensating valve 12 and the other pressure compensating valves 13–16. Also, a differential pressure set by the lower limit setting spring 55 (i.e., a lower limit of the target compensation differential pressure) is denoted by Pb.

During the swing-combined operation in which the swing motor 2 and the other actuators are driven simultaneously, when the total Qr of the valve demanded flow rates of the directional control valve 7 and the other directional control valves 8–11 is smaller than a maximum delivery rate Qpmax of the hydraulic pump 1 and hence the delivery rate of the hydraulic pump 1 is not in the saturation state, the target compensation differential pressure ΔPv of all the pressure compensating valves, including the pressure compensating valve 12, is constant at the LS control differential pressure ΔPc.

When the total Qr of the valve demanded flow rates exceeds the maximum delivery rate Qpmax of the hydraulic pump 1 and hence the delivery rate of the hydraulic pump 1 is brought into the saturation state, the target compensation differential pressure ΔPv of all the pressure compensating valves is reduced with a lowering of the LS control differential pressure ΔPc until the LS control differential pressure ΔPc lowers down to the differential pressure Pb set by the lower limit setting spring 55 in the pressure compensating valve 12 for the swing section. When the LS control differential pressure ΔPc lowers down to the differential pressure Pb set by the lower limit setting spring 55, the target compensation differential pressure ΔPv of the pressure compensating valve 12 is held thereafter at the differential pressure Pb set by the lower limit setting spring 55 and is no more reduced beyond the lower limit, whereas the target compensation differential pressure ΔPv of the pressure compensating valves not for the swing section continues reducing with a lowering of the LS control differential pressure ΔPc.

In FIG. 4, a thick broken line indicates change in the target compensation differential pressure ΔPv of the pressure compensating valves 13–16 not for the swing section during the combined operation including the swing section, and a thin broken line indicates change in the target compensation differential pressure ΔPv of the pressure compensating valves 13–16 during the combined operation not including the swing section. Since the target compensation differential pressure ΔPv of the pressure compensating valve 12 for the swing section is not reduced down below the differential pressure Pb set by the lower limit setting spring 55, the target compensation differential pressure ΔPv of the pressure compensating valves 13–16 not for the swing section during the combined operation including the swing section is reduced at a greater rate than the target compensation differential pressure ΔPv of the pressure compensating valves 13–16 during the combined operation not including the swing section.

Figure 5:
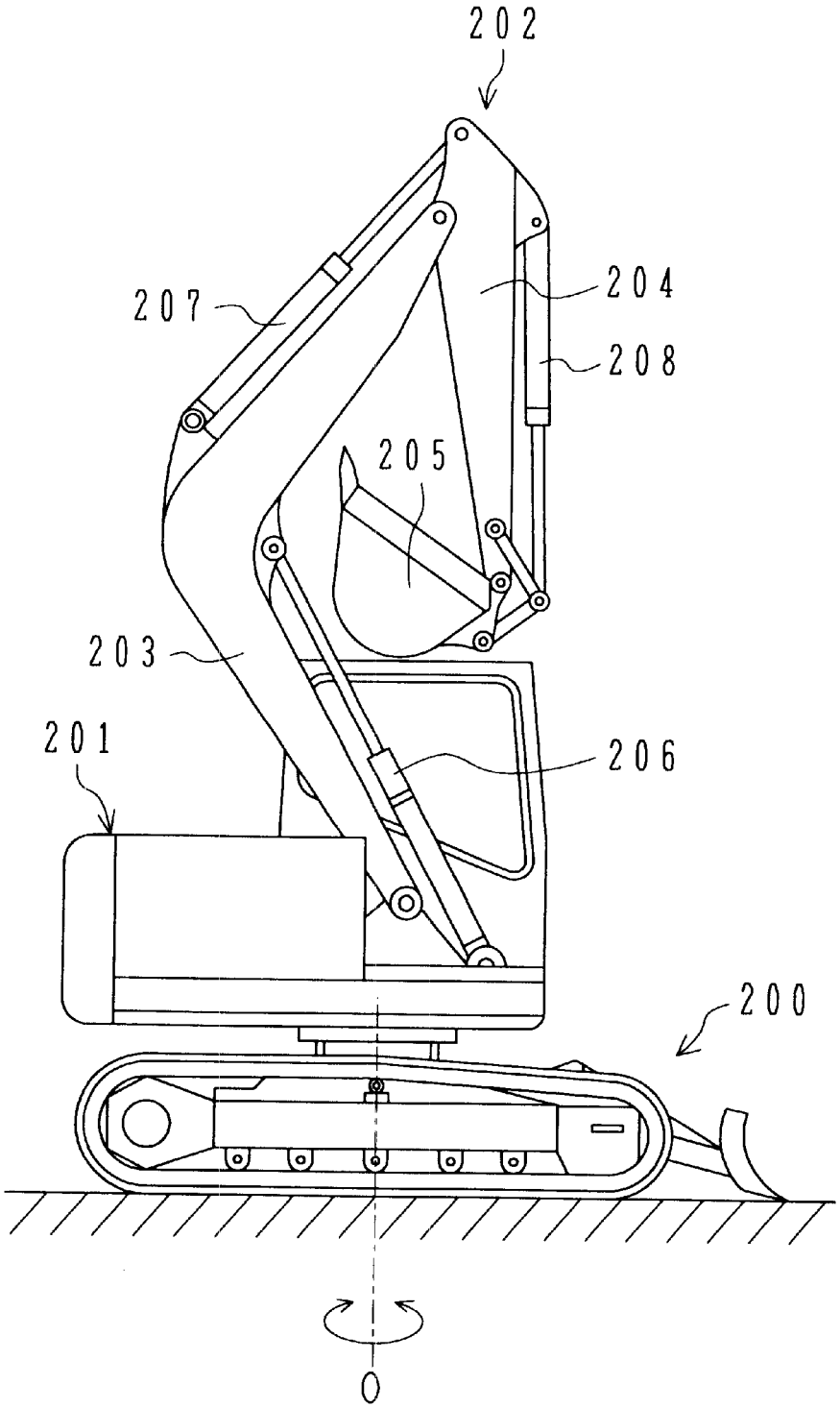
FIG. 5 shows an appearance of a hydraulic excavator to which the hydraulic drive system of the present invention is applied.

The hydraulic drive system described above is installed, for example, in a hydraulic excavator. FIG. 5 shows an appearance of the hydraulic excavator. Referring to FIG. 5, the hydraulic excavator comprises a lower track structure 200, an upper swing structure 201, and a front operating mechanism 202. The upper swing structure 201 is able to swing on the lower track structure 200 about an axis O, and the front operating mechanism 202 is able to move vertically in front of the upper swing structure 201. The front operating mechanism 202 has a multi-articulated structure comprising a boom 203, an arm 204 and a bucket 205. The boom 203, the arm 204 and the bucket 205 are driven respectively by a boom cylinder 206, an arm cylinder 207 and a bucket cylinder 208 for rotation in a plane that contains the axis O. The swing motor 2 shown in FIG. 1 is an actuator for driving the upper swing structure 202 to swing on the lower track structure 200. Three of the other actuators 3–6 are employed as the boom cylinder 206, the arm cylinder 207 and the bucket cylinder 208.

In the above construction, the fluid chambers 13*a*–16*a*, 13*b*–16*b* communicating with the signal lines 52*b*–52*e*, 53*b*–53*e* of the pressure compensating valves 13–16 constitute first means provided respectively in those 13–16 of the plurality of pressure compensating valves 12–16, which are not for the swing section associated with the swing motor 2, and setting, as the target compensation differential pressure, the differential pressure between the delivery pressure of the hydraulic pump 1 and the maximum load pressure among the plurality of actuators 2–6. The fluid chamber 336 (having the pressure bearing area B2=B1) and the fluid chamber 331 (having the pressure bearing area B1) communicating respectively with the signal lines 52*a*, 53*a* of the pressure compensating valve 12 constitute second means provided in the pressure compensating valve 12 for the swing section and setting the target compensation differential pressure of the pressure compensating valve 12. The fluid chamber 334 (having the pressure bearing area B1>B3) and the fluid chamber 332 (having the pressure bearing area B3) communicating respectively with the signal lines 50*a*, 51*a* of the pressure compensating valve 12 constitute third means provided in at least one 12 of the plurality of pressure compensating valves 12–16, which is for the swing section, and reducing the target compensation differential pressure set by the second means when the load pressure of the swing motor 2 rises, thereby giving a load dependent characteristic to the pressure compensating valve 12 for the swing section. The lower limit setting spring 55 in the pressure compensating valve 12 constitutes fourth means provided in the pressure compensating valve 12 for the swing section and setting a lower limit of the target compensation differential pressure that is set by the second means and modified by the third means.

Further, in this embodiment, the second means (the fluid chambers 331, 336) is means for setting, as the target compensation differential pressure, the differential pressure between the delivery pressure of the hydraulic pump 1 and the maximum load pressure among the plurality of actuators 2–6 as with the first means (the fluid chambers 13*a*–16*a*, 13*b*–16*b*). The fourth means (the lower limit setting spring 55) functions as lower limit setting means for limiting both reduction in the target compensation differential pressure itself set by the second means (the fluid chambers 331, 336) and reduction in the target compensation differential pressure due to the load dependent characteristic given by the third means (the fluid chambers 332, 334).

Additionally, the fourth means (the lower limit setting spring 55) is biasing means for applying a biasing force to the spool 311 of the pressure compensating valve 12 for the swing section in the valve-opening direction when the target compensation differential pressure set by the second means (the fluid chambers 331, 336) and modified by the third means (the fluid chambers 332, 334) reaches a predetermined value.

The operation of this embodiment thus constructed will be described.

1. Operation of Swing Alone

Figure 6:
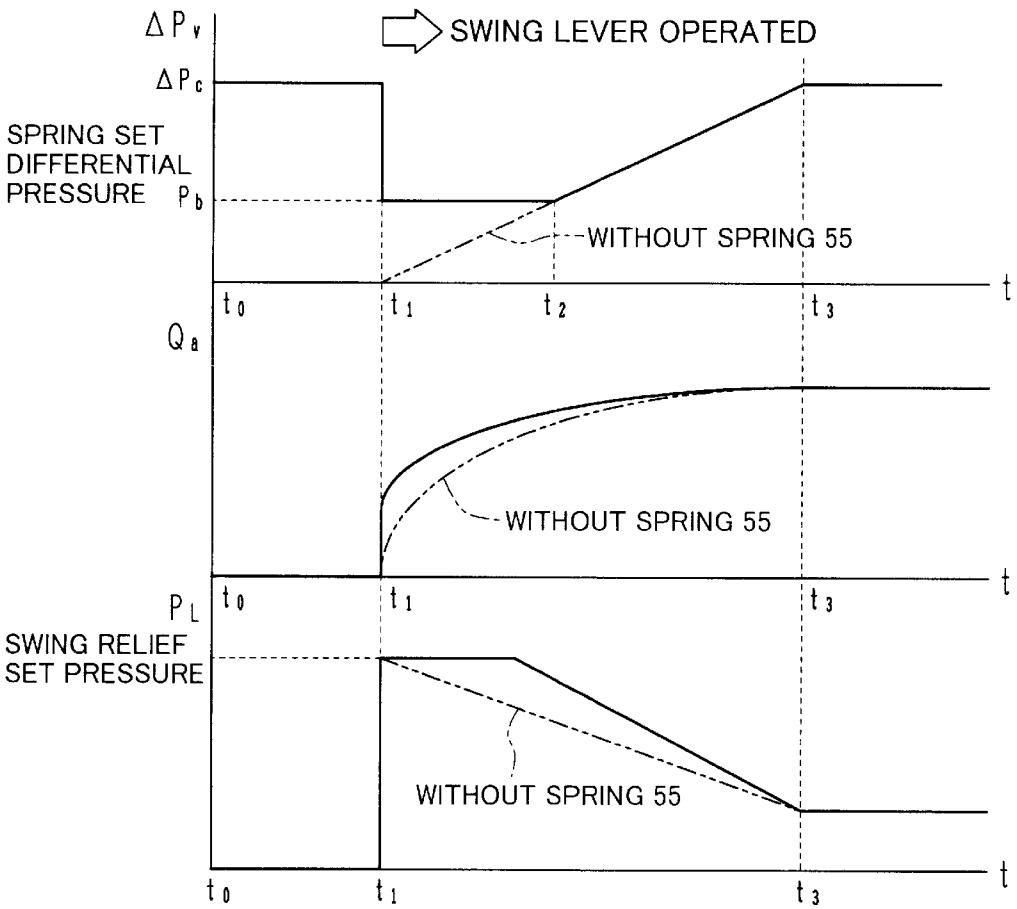
FIG. 6 is a time chart showing change in the target compensation differential pressure of the pressure compensating valve for the swing section during the operation of swing alone.

FIG. 6 is a time chart showing the behavior of the swing-associated pressure compensating valve 12 during the operation of swing alone in which the swing-associated directional control valve 7 is operated and the swing motor 2 is driven solely.

At the start-up of the swing-alone operation, there occurs a rise of the load pressure of the upper swing structure 201 specific to an inertial load. Such a rise of the load pressure is restricted by a safety valve that is constructed by the overload relief valve 60*a* or 60*b* disposed in association with the swing motor 2. In this condition, the hydraulic fluid supplied to the swing motor 2 is drained to the reservoir through the safety valve 60*a* or 60*b*.

In a conventional general pressure compensating valve, an acceleration feel of the upper swing structure 201, which is an inertial load, has been adjusted with the drain of the hydraulic fluid through the safety valve. In this case, however, since a flow rate of the hydraulic fluid drawn by the swing motor at the start-up is small, most of the hydraulic fluid is drained to the reservoir, thus resulting in an energy loss. Also, it is difficult to keep balance between the LS control of the hydraulic pump and the flow rate compensating function of the pressure compensating valve, causing the operator to feel jerky in the swing operation.

By contrast, this embodiment is free from such a problem because the pressure compensating valve 12 for the swing section has the load dependent characteristic described above.

First, in a condition prior to the start-up where the control lever of the swing-associated control lever unit is not operated, the target compensation differential pressure ΔPv of the pressure compensating valve 12 is controlled to the LS control differential pressure ΔPc (t0–t1).

Then, when the swing motor 2 is started up by operating the control lever, the load pressure PL rises due to the inertial load at the same time as the start-up (t1).

With the load dependent characteristic of the pressure compensating valve 12, the target compensation differential pressure ΔPv is reduced down from the LS control differential pressure ΔPc until reaching the differential pressure Pb set by the lower limit setting spring 55 (t1). A supply flow rate Qa to the swing motor 2 is controlled to a value corresponding to the differential pressure Pb set by the spring 55. In the case of not including the lower limit setting spring 55, the target compensation differential pressure ΔPv is further reduced down below Pb (but will not become zero).

When the upper swing structure 201 starts rotation and the swing speed rises, the flow rate of the hydraulic fluid drawn by the swing motor 2 is balanced by the supply flow rate Qa to the swing motor 2 and the load pressure lowers gradually. As a result, the target compensation differential pressure ΔPv of the pressure compensating valve 12 increases gradually (t2).

When the flow rate of the hydraulic fluid drawn by the swing motor 2 is not balanced by the supply flow rate Qa to the swing motor 2, this condition is fed back, as a rise or fall of the load pressure PL, to the pressure compensating valve 12 for the swing section. With the load dependent characteristic of the pressure compensating valve 12, when the supply flow rate Qa is too large, the load pressure PL increases and therefore the supply flow rate Qa is restricted by the pressure compensating valve 12. Conversely, when the supply flow rate Qa is insufficient, the load pressure PL decreases and therefore the supply flow rate Qa is increased by the pressure compensating valve 12. Such fine adjustment of the pressure compensating valve 12 enables the swing motor 2 to be moderately accelerated without causing hunting that has been generated in the conventional LS control.

At the time when the supply flow rate reaches an intrinsic value, the swing motor comes into a steady state (t3) and the load pressure PL is given by a pressure due to the rotation resistance.

2. Start-up of Another Actuator during Steady Rotation in Swing

Figure 7:
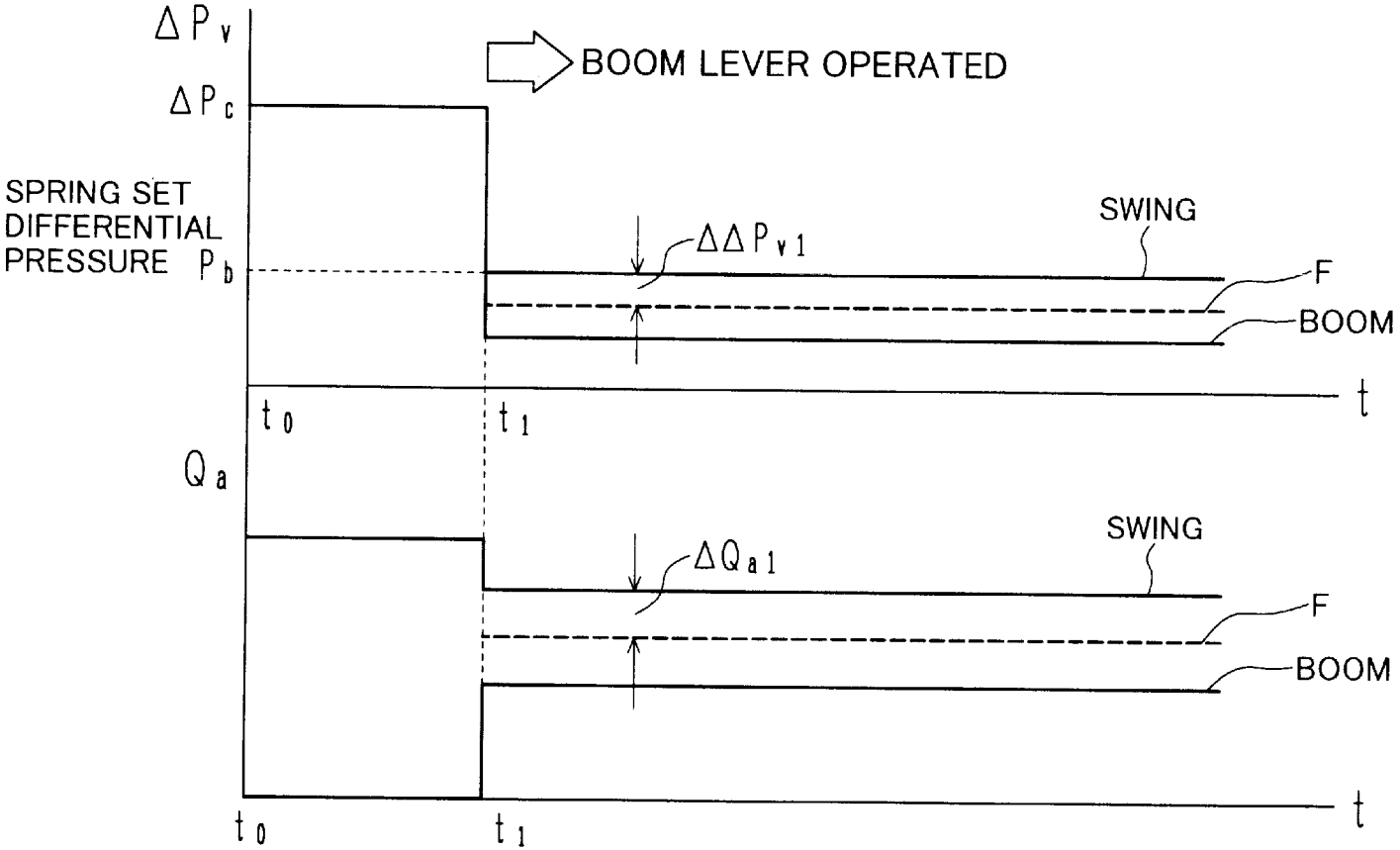
FIG. 7 is a time chart for explaining the operation of the pressure compensating valve for the swing section when another actuator is started up during steady swing rotation and the degree of saturation is large, F in the figure indicating, for reference, the combined operation not including swing or the combined operation including swing with a spring 55 not provided.

FIG. 7 is a time chart showing the behavior of the pressure compensating valves for the respective sections during the combined operation in which, during steady rotation in the swing-alone operation, another actuator, e.g., the boom cylinder, is started up. It is assumed that the actuator 3 serves as the boom cylinder.

During steady rotation in the swing-alone operation, the load pressure PL of the swing motor 2 is lowered to a level just necessary for the steady rotation, and the target compensation differential pressure ΔPv of the pressure compensating valve 12 is controlled almost to the LS control differential pressure ΔPc (t0–t1).

In the case of additionally operating the control lever of the control lever unit for the boom, there occurs saturation when a total flow rate demanded by the swing motor 2 and the boom cylinder 3 exceeds the maximum delivery rate available from the hydraulic pump 1. Upon the occurrence of saturation, the LS control differential pressure ΔPc is reduced in proportion to a deficiency of the supply flow rate with respect to the demanded flow rate Qr and the target compensation differential pressure ΔPv of the pressure compensating valves 12, 13 is reduced correspondingly, whereby redistribution of the flow rate takes place (t1).

Here, when the degree of saturation is large, the target compensation differential pressure ΔPv is reduced to a large extent, but reduction in the target compensation differential pressure ΔPv of the pressure compensating valve 12 for the swing section is restricted to the differential pressure Pb set by the lower limit setting spring 55. Therefore, the target compensation differential pressure ΔPv of the pressure compensating valve 13 for the boom section is further reduced by an amount corresponding to the restricted reduction in the target compensation differential pressure ΔPv on the swing side.

As a result, in the combined operation including the swing, the hydraulic fluid can be supplied to the swing motor 2 with some priority. With this function, it is possible to realize operability of the swing motor 2 independently of the other actuators in the saturation state, to suppress change of the swing speed during the combined operation, and hence to ensure satisfactory swing operability.

In the combined operation not including the swing, as a comparative example, the target compensation differential pressure ΔPv is reduced to the same value for each section with a lowering of the LS control differential pressure ΔPc due to the saturation, and the supply flow rate Qa is also reduced to the same value for each section (on an assumption that the directional control valves associated with the combined operation have the same opening area). This is similarly applied to the combined operation including the swing in the case where the lower limit setting spring 55 is not provided in the pressure compensating valve 12 for the swing section (JP, A, 10-89304). By providing the lower limit setting spring 55, the reduction in the target compensation differential pressure ΔPv and the supply flow rate Qa for the swing section is suppressed by amounts of ΔΔPv1 and ΔQa1 in comparison with the above case. Consequently, the hydraulic fluid is supplied to the swing motor 2 with priority and change of the swing speed during the combined operation can be suppressed.

Figure 8:
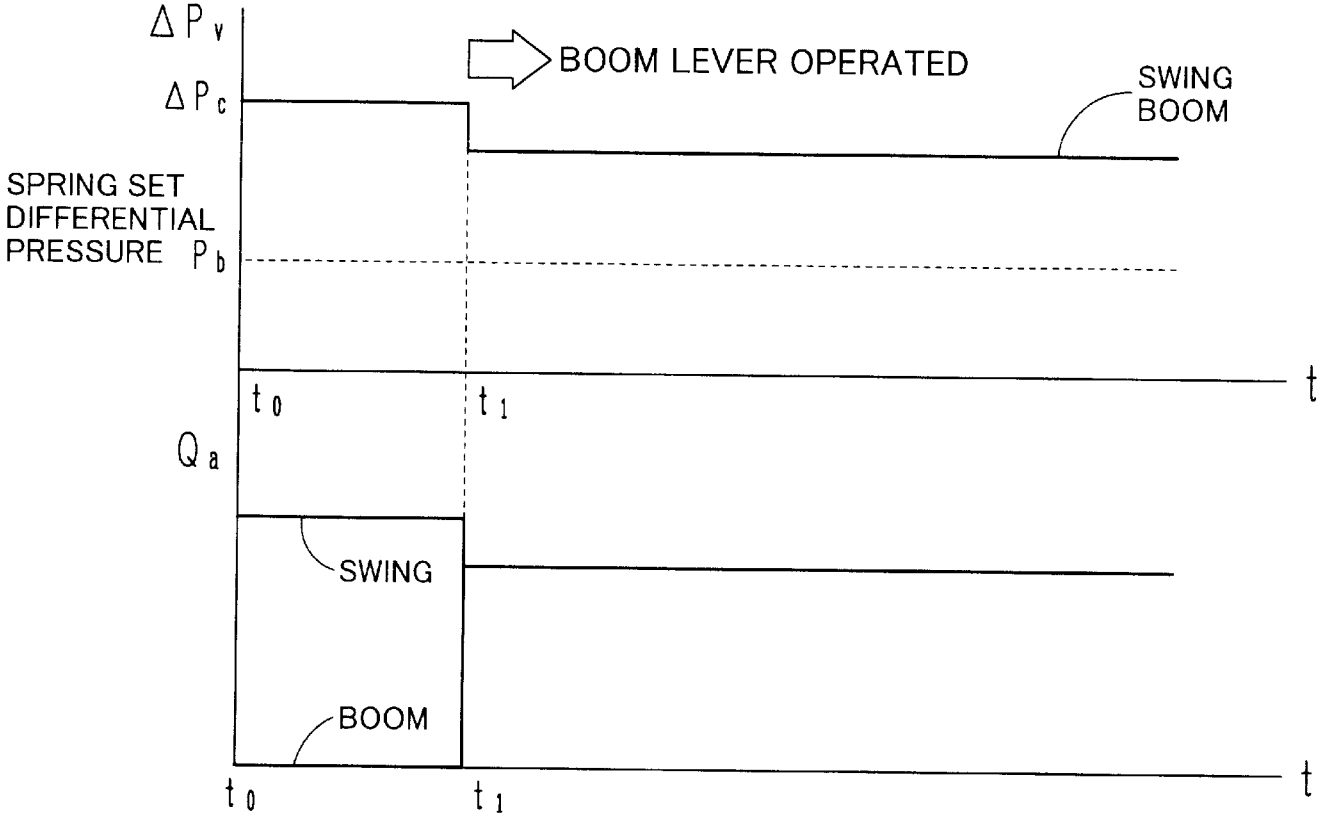
FIG. 8 is a time chart for explaining the operation of the pressure compensating valve for the swing section when another actuator is started up during the steady swing rotation and the degree of saturation is small.

FIG. 8 shows the case where the degree of saturation of the delivery rate of the hydraulic pump 1 during the above combined operation is small.

When the degree of saturation is small, the target compensation differential pressure ΔPv is not reduced down to the differential pressure Pb set by the lower limit setting spring 55. In this case, the target compensation differential pressure ΔPv and the supply flow rate Qa are reduced to the same values for both the swing and the boom (on an assumption that the directional control valves 7, 8 for the swing and boom sections have the same opening area).

Thus, based on the setting of the lower limit setting spring 55, the swing can be given priority of which degree is set depending on the degree of saturation.

3. Simultaneous Start-up of Swing and Another Actuator

Figure 9:
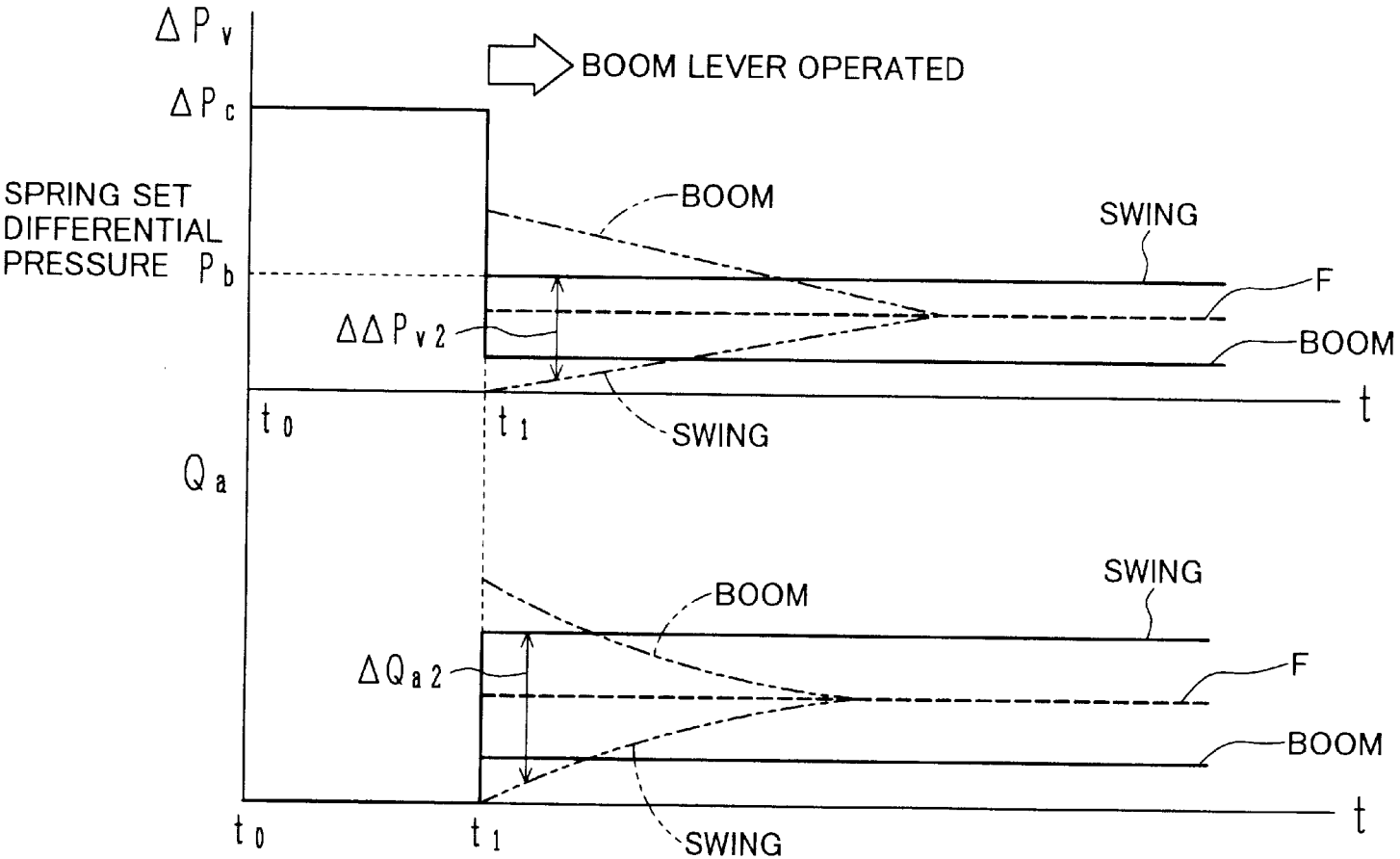
FIG. 9 is a time chart for explaining the operation of the pressure compensating valve for the swing section when the swing is started up simultaneously with another actuator and the degree of saturation is large, F in the figure indicating, for reference, the combined operation not including swing or-the combined operation including swing with the spring 55 not provided.

FIG. 9 is a time chart showing the behavior of the pressure compensating valves for the respective sections during the combined operation in which another actuator, e.g., the boom cylinder, is started up at the same time as the swing start-up. It is here likewise assumed that the actuator 3 serves as the boom cylinder.

First, in a condition prior to the start-up where the control levers of the control lever units for the swing and the boom are not operated, the target compensation differential pressure ΔPv of the pressure compensating valves 12, 13 is controlled to the LS control differential pressure ΔPc (t0–t1).

Then, when the swing motor 2 and the boom cylinder 3 are simultaneously started up by operating the control levers for the swing and the boom at the same time, there occurs saturation when a total flow rate demanded for the swing and the boom exceeds the maximum delivery rate of the hydraulic pump 1. Upon the occurrence of saturation, the LS control differential pressure ΔPc is reduced in proportion to a deficiency of the supply flow rate with respect to the demanded flow rate Qr and the target compensation differential pressure ΔPv of the pressure compensating valves 12–16 is reduced correspondingly, whereby redistribution of the flow rate takes place (t1).

Also in this case, with fine adjustment based on the load dependent characteristic of the pressure compensating valve 12 for the swing section, the swing motor 2 is moderately accelerated without causing hunting that has been generated in the conventional LS control.

When the degree of saturation is large, the target compensation differential pressure ΔPv is reduced to a large extent. Further, in the pressure compensating valve 12 for the swing section, since the load pressure PL of the swing motor 2 rises due to the inertial load at the same time as the start-up of the swing motor 2, the target compensation differential pressure ΔPv is additionally reduced in accordance with the load dependent characteristic of the pressure compensating valve 12. This reduction in the target compensation differential pressure ΔPv of the pressure compensating valve 12 is restricted to the differential pressure Pb set by the lower limit setting spring 55. Therefore, the target compensation differential pressure ΔPv of the pressure compensating valve 13 for the boom section is further reduced by an amount corresponding to the restricted reduction in the target compensation differential pressure ΔPv on the swing side.

As a result, the delivery rate of the hydraulic pump 1 is supplied to the swing motor 2 with some priority. With this function, it is possible to avoid the swing speed from extremely slowing down as compared with the speed of the boom cylinder 3, and hence to maintain satisfactory swing operability.

In the combined operation not including the swing, as a comparative example, the target compensation differential pressure ΔPv is reduced to the same value for each section with a lowering of the LS control differential pressure ΔPc due to the saturation, and the supply flow rate Qa is also reduced to the same value for each section, as indicated by broken lines in FIG. 9 (on an assumption that the directional control valves associated with the combined operation have the same opening area).

During the combined operation including the swing in the case where the lower limit setting spring 55 is not provided in the pressure compensating valve 12 for the swing section (JP, A, 10-89304), as indicated by two-dot chain lines in FIG. 9, the target compensation differential pressure ΔPv is extremely reduced in accordance with both a lowering of the LS control differential pressure ΔPc due to the saturation and the load dependent characteristic of the pressure compensating valve 12, and the supply flow rate Qa is also extremely reduced. In this embodiment, such reduction in the target compensation differential pressure ΔPv of the pressure compensating valve 12 is restricted by the differential pressure Pb set by the lower limit setting spring 55. As compared with the case not including the spring 55, therefore, the reduction in the target compensation differential pressure ΔPv and the supply flow rate Qa for the swing section is suppressed by amounts of ΔΔPv2 and ΔQa2. With this function, during the combined operation, it is possible to avoid the swing speed from extremely slowing down as compared with the speed of another actuator, and hence to maintain satisfactory swing operability.

Figure 10:
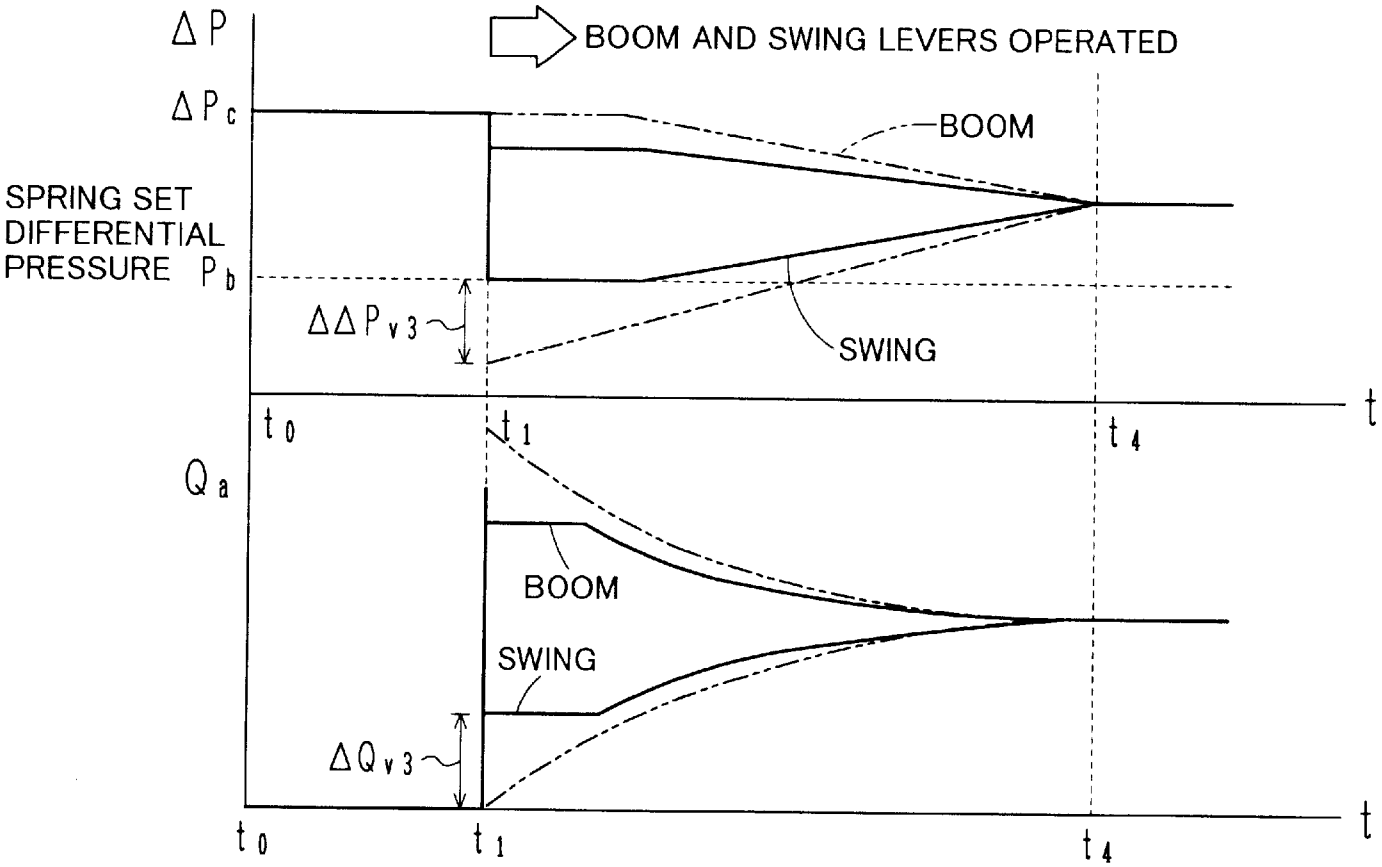
FIG. 10 is a time chart for explaining the operation of the pressure compensating valve for the swing section when the swing is started up simultaneously with another actuator and the degree of saturation is small.

FIG. 10 shows the case where the degree of saturation of the delivery rate of the hydraulic pump 1 during the above combined operation is small.

When the degree of saturation is small, the target compensation differential pressure ΔPv of the pressure compensating valve 13 for the boom section is not reduced down to the differential pressure Pb set by the lower limit setting spring 55. The target compensation differential pressure ΔPv for the swing section is reduced down to the differential pressure Pb set by the lower limit setting spring 55.

As the swing speed rises, the load pressure of the swing motor 2 is lowered and the target compensation differential pressure ΔPv of the pressure compensating valve 12 for the swing section is increased. Finally, the target compensation differential pressure ΔPv and the supply flow rate Qa have the same values for both the swing and boom sections (on an assumption that the directional control valves for the swing and boom sections have the same opening area)(t4).

In the case where the lower limit setting spring 55 is not provided in the pressure compensating valve 12 for the swing section (JP, A, 10-89304), as indicated by two-dot chain lines in FIG. 10, the target compensation differential pressure ΔPv of the pressure compensating valve 12 for the swing section is reduced down to a pressure below Pb, and the supply flow rate Qa to the swing motor 2 is also extremely reduced immediately after the start-up. By providing the lower limit setting spring 55, the reduction in the target compensation differential pressure ΔPv and the supply flow rate Qa for the swing section is suppressed by amounts of ΔΔPv3 and ΔQa3 in comparison with the above case. Consequently, it is also possible to avoid the swing speed from extremely slowing down as compared with the speed of another actuator, and hence to maintain satisfactory swing operability.

With this embodiment, as described above, since the pressure compensating valve 12 for the swing section has the load dependent characteristic, the swing operation can be smoothly accelerated and shifted to the steady state without causing a jerky feel at the start-up in any of swing alone and the combined operation including swing. Also, since the lower limit setting spring 55 is provided in the pressure compensating valve 12 for the swing section to supply the hydraulic fluid to the swing motor 2 with priority when the delivery rate of the hydraulic pump 1 is in the saturation state, change of the swing speed is suppressed at shift from the swing-alone operation to the swing-combined operation, and so does at reverse shift from the swing-combined operation to the swing-alone operation. Further, at the start-up of the swing-combined operation, the swing speed can be accelerated without being extremely slowed down as compared with the speed of another actuator, whereby superior swing operability and swing independence can be ensured. Additionally, since the above-described functions are achieved without providing a separate circuit, such problems as an increase in cost and space and complication of the circuit configuration are avoided.

A second embodiment of the present invention will be described with reference to FIGS. 11 to 14. In these figures, equivalent members to those shown in FIGS. 1 and 2 are denoted by the same numerals. In this embodiment, a swing priority spring is provided so as to always act on a spool of a pressure compensating valve.

Figure 11:
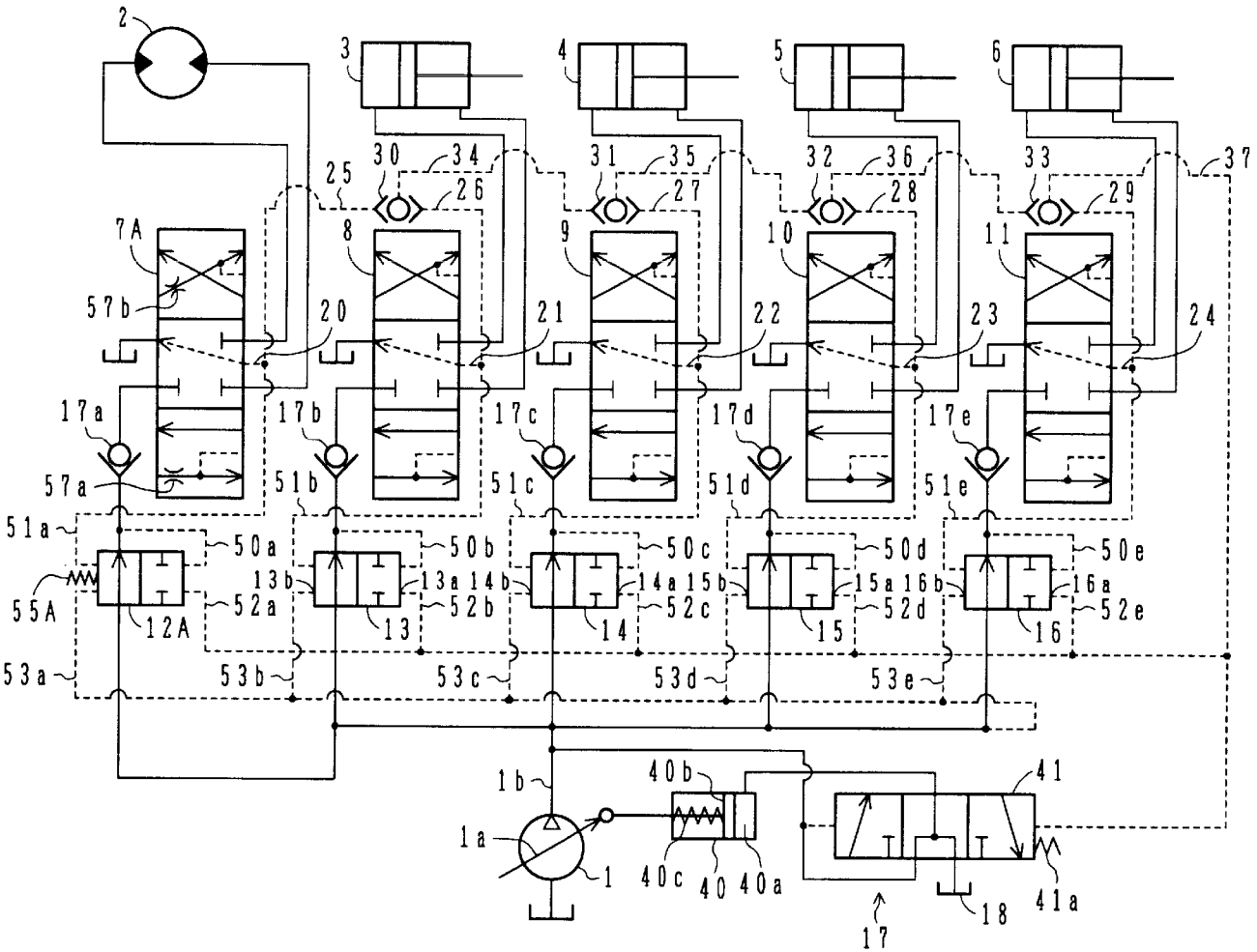
FIG. 11 is a circuit diagram showing a hydraulic drive system according to a second embodiment of the present invention.

Referring to FIG. 11, pressure compensating valves 13–16 for sections other than a swing section are the same as those in the first embodiment.

In a pressure compensating valve 12A for the swing section, the pressure upstream of a directional control valve 7A acts in the valve-closing direction, the pressure (load pressure) in the detection lines 20–24 given by the pressure downstream of the directional control valve 7A acts in the valve-opening direction, and the delivery pressure of the hydraulic pump 1 acts in the valve-opening direction, whereby the differential pressure across the directional control valve 7A is controlled using, as the target compensation differential pressure, the LS control differential pressure (differential pressure between the delivery pressure of the hydraulic pump 1 having been subjected to the LS control and the maximum load pressure). Further, the pressure compensating valve 12A is constructed to have such a load dependent characteristic that when the load pressure of the swing motor 2 rises, the target compensation differential pressure is reduced to restrict the flow rate of the hydraulic fluid passing the directional control valve 7A. These points are also the same as the pressure compensating valve 12 in the first embodiment.

In addition, the pressure compensating valve 12A includes a swing priority spring 55A provided on the side acting in the valve-opening direction, i.e., on the side setting the target compensation differential pressure. The swing priority spring 55A always acts on a spool of the pressure compensating valve 12A during operation of the pressure compensating valve 12A, thereby setting a certain supplement target compensation differential pressure for the swing priority operation which is added to the target compensation differential pressure given by the LS control differential pressure. In other words, the target compensation differential pressure of the pressure compensating valve 12A is higher than that of the pressure compensating valves 13–16 not for the swing section by a value set by the swing priority spring 55A.

Further, in the directional control valve 7A for the swing section, meter-in variable throttles 57*a*, 57*b* each have an opening area set to be smaller than the usual area thereof corresponding to the target compensation differential pressure of the pressure compensating valve 12A which is set to a higher value, so that a flow rate characteristic is provided as per design when the delivery rate of the hydraulic pump 1 is not in the saturation state.

Figure 12:
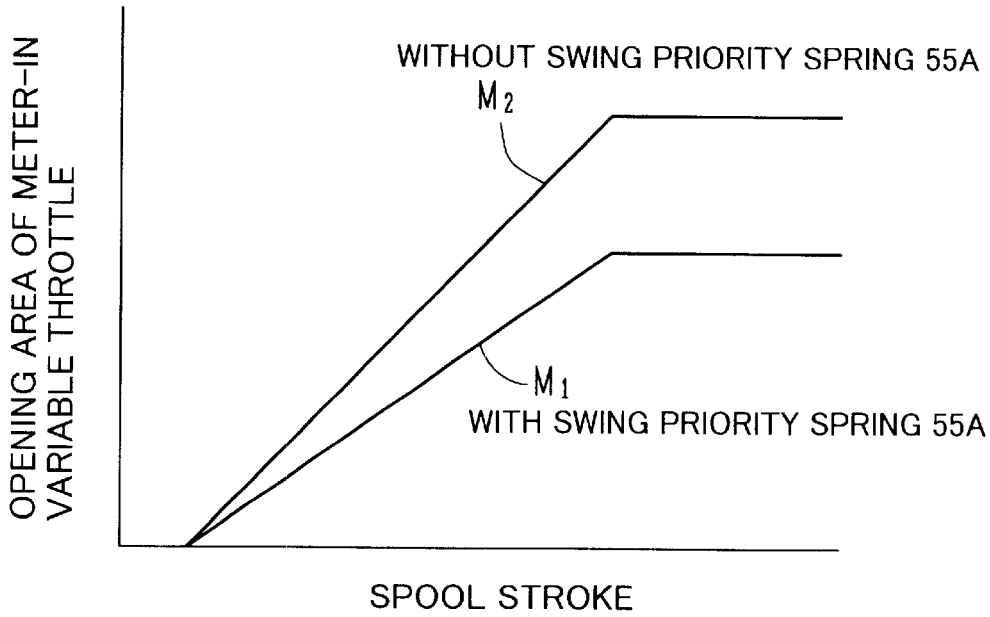
FIG. 12 is a graph showing an opening area characteristic of a directional control valve for a swing section.

FIG. 12 shows the relationship between a spool stroke and the throttle opening area. In FIG. 12, M1 indicates change in the opening area (opening area characteristic) of each meter-in variable throttle 57*a*, 57*b* with respect to the spool stroke of the directional control valve 7A. M2 indicates change in the opening area (opening area characteristic) of meter-in variable throttles with respect to a spool stroke of a directional control valve (e.g., the directional control valve 7A in the first embodiment shown in FIG. 1) which does not include the swing priority spring 55A and is under the rated conditions. The opening area characteristics are set such that M1 provides a larger opening area at the same spool stroke than M2.

Figure 13:
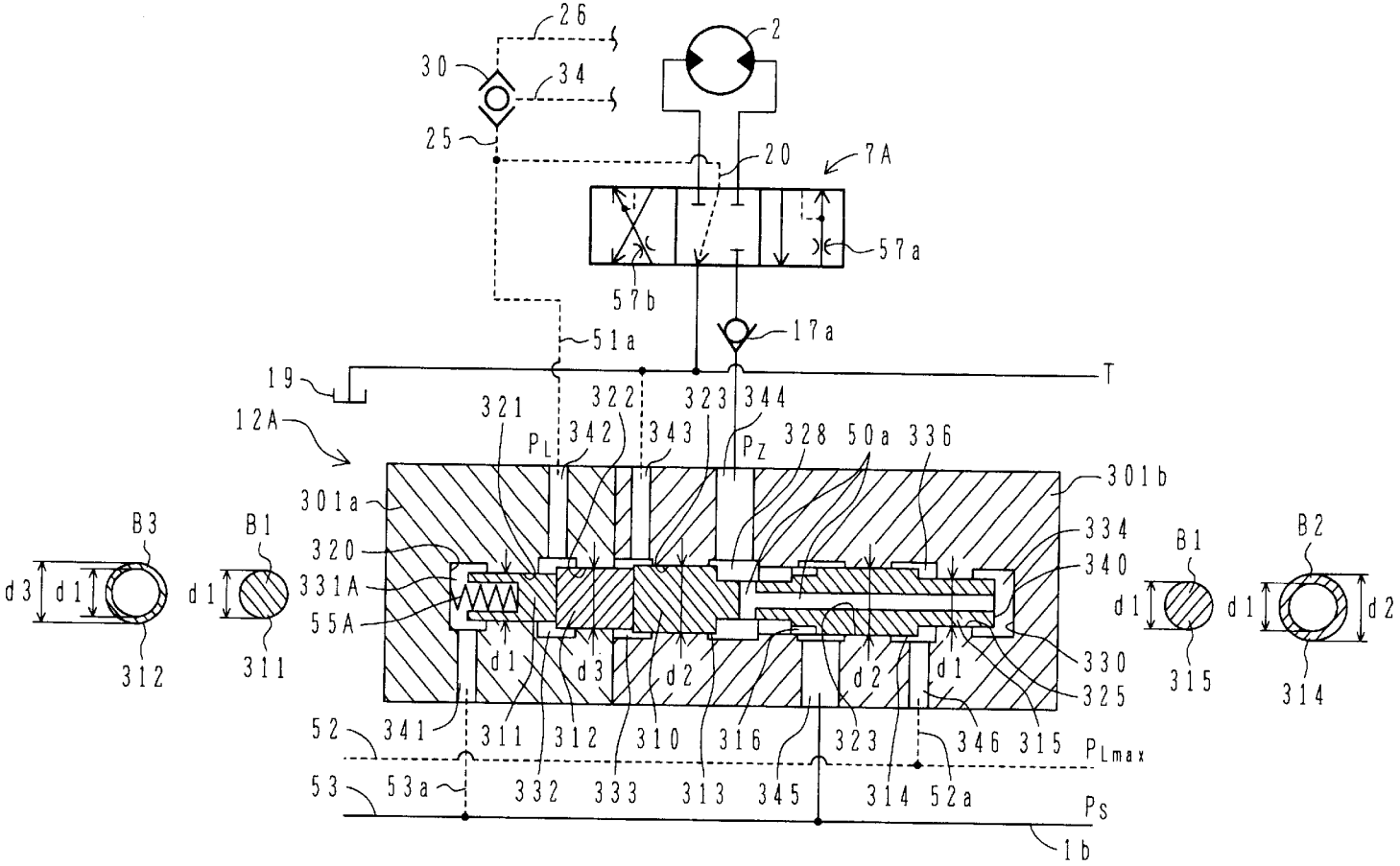
FIG. 13 is a sectional view showing details of the structure of a pressure compensating valve for the swing section.

The structure of the pressure compensating valve 12A is shown in FIG. 13. A small-diameter bore 321 having an end surface 320 is formed in a first body 301*a*. In a fluid chamber 331A next to the end surface 320 of the small-diameter bore 321, the swing priority spring 55A is disposed between the first spool 311 fitted in the small-diameter bore 321 and the end surface 320 of the small-diameter bore 321 so as to push the first spool 311, a second spool 312 and a third spool 310 in the valve-closing direction. Pressure bearing areas B1, B3, B1, B2 of the fluid chambers 331A, 332, 334, 336 are set to have the same relationship as that in the first embodiment, i.e., the relationship among the pressure bearing areas B1, B3, B1, B2 of the fluid chambers 331, 332, 334, 336 shown in FIG. 2. Also, the other construction of the pressure compensating valve 12A is the same as that in the first embodiment shown in FIG. 2.

The operating principle of the swing priority spring 55A in the pressure compensating valve 12A will be described.

The lower limit setting spring 55 in the pressure compensating valve 12 according to the first embodiment functions to set a lower limit in the target compensation differential pressure so that the target compensation differential pressure will not become smaller than the predetermined value. Assuming the lower limit value of the target compensation differential pressure to be Pb as mentioned above, in this embodiment, the swing priority spring 55A functions to always act on the spool so that a target compensation differential pressure corresponding to the lower limit value Pb is added to the target compensation differential pressure given by the LS control differential pressure. As a result, the target compensation differential pressure of the pressure compensating valve 12A is Pb larger than that of the pressure compensating valves 13–16. In other words:

the target compensation differential pressure of the pressure compensating valves 13–16: Ps−PLmax the target compensation differential pressure of the pressure compensating valve 12A: Ps−PLmax+Pb By thus setting the target compensation differential pressure of the pressure compensating valve 12A, the hydraulic fluid would flow into the swing motor 2 only at a flow rate, which is Pb larger than the flow rate supplied to the other actuators, if the opening area of each meter-in variable throttle of the directional control valve for the swing section is set to the same value as the usual area. Accordingly, the opening area of the meter-in variable throttle of the directional control valve for the swing section is required to be smaller by an amount corresponding to Pb, causing the hydraulic fluid to flow into the swing motor 2 at the same flow rate as usual.

More specifically, assuming that the opening area of the swing-associated directional control valve at the target compensation differential pressure under the intrinsic rated conditions is As and the opening area of the meter-in variable throttle of the directional control valve 7A is Aso, the following formula is obtained:

$$Aso=As\sqrt{((Ps-PL\max)/(Ps-PL\max+Pb))}$$

Change in the supply flow rate to the swing motor 2 in the saturation state, resulted when using the pressure compensating valve 12A and directional control valve 7A, will be described in comparison with change in the supply flow rate to another actuator. Assuming that the opening area of the directional control valve associated with another actuator is As, i.e., the same as the opening area of the swing-associated directional control valve at the target compensation differential pressure under the rated conditions, the supply flow rate to the swing motor 2 is Qa, and the supply flow rate to another actuator is Qb, Qa and Qb are expressed by:

$$\begin{aligned} Qb &= c\times As\sqrt{((2/\rho)(Ps-PLmax))} \\ &= c\times As\sqrt{((2/\rho)\Delta Pc)} \\ Qa &= c\times Aso\times\sqrt{((2/\rho)(\Delta Pc+Pb))} \\ &= c\times As\sqrt{((Ps-PLmax)/(Ps-PLmax+Pb))}\times \\ &\quad \sqrt{((2/\rho)(\Delta Pc+Pb))} \end{aligned}$$

Here, As√ ((Ps−PLmax)/(Ps−PLmax+Pb)) is a value (constant) under the rated conditions.

The rated conditions are now set as given below.

$$Ps-PL\max=15\ \text{kgf/cm}^2$$

$$Pb=3\ \text{kgf/cm}^2$$

$$Qa=Qb=85(\text{liter/min})$$

Accordingly:

$$V((Ps-PL\max)/(Ps-PL\max+Pb))=\sqrt{(15/(15+3))}\approx 0.91$$

$$c\times As\sqrt{(2/\rho)}=Q/\sqrt{\Delta Pc}\approx 21.94$$

Putting those value in the above formulae of Qb and Qa:

$$Qb=21.94\sqrt{\Delta Pc}$$

$$Qa=21.94\times 0.91\sqrt{(\Delta Pc+Pb)}$$

Figure 14:
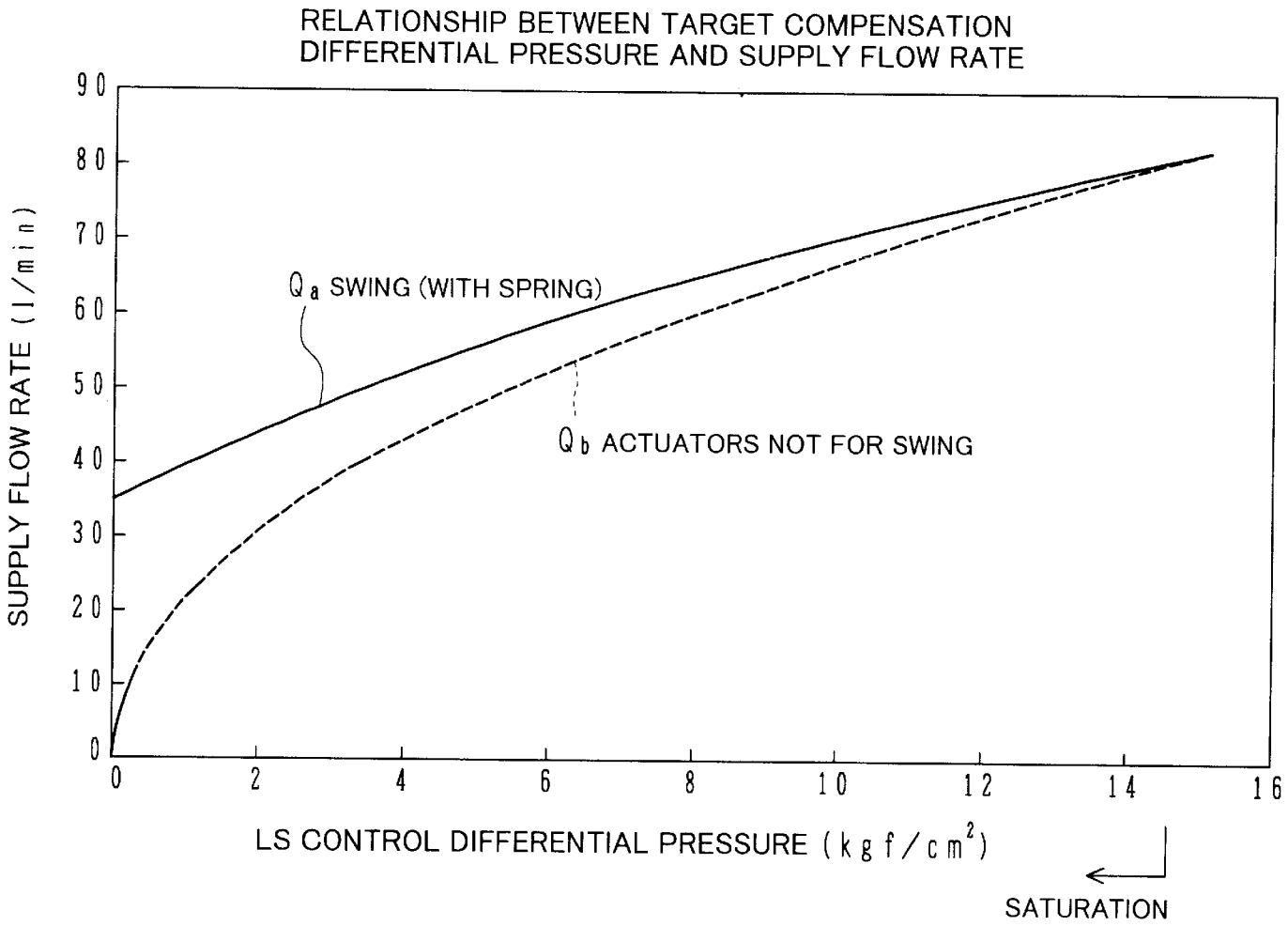
FIG. 14 is a graph showing a priority characteristic of a swing-section flow rate in a saturation state.

FIG. 14 shows the relationships between Qa, Qb and the LS control differential pressure ΔPc in comparative fashion. As seen from FIG. 14, when the LS control differential pressure ΔPc becomes not larger than 15 kgf/cmz, i.e., in the saturation state where the delivery rate of the hydraulic pump 1 is not sufficient to satisfy the demanded flow rate, the supply flow rate Qa to the swing motor 2 is greater than the supply flow rate Qb to another actuator not for the swing, and the hydraulic fluid is supplied to the swing motor 2 with priority. Further, the degree of priority (difference between both the supply flow rates) is increased as the LS control differential pressure ΔPc decreases.

In the above construction, the fluid chambers 13*a*–16*a*, 13*b*–16*b* communicating with the signal lines 52*b*–52*e*, 53*b*–53*e* of the pressure compensating valves 13–16 constitute first means provided respectively in those 13–16 of the plurality of pressure compensating valves 12–16, which are not for the swing section associated with the swing motor 2, and setting, as the target compensation differential pressure, the differential pressure between the delivery pressure of the hydraulic pump 1 and the maximum load pressure among the plurality of actuators 2–6. The fluid chamber 336 (having the pressure bearing area B2=B1) and the fluid chamber 331A (having the pressure bearing area B1) communicating respectively with the signal lines 52*a*, 53*a* of the pressure compensating valve 12A constitute second means provided in the pressure compensating valve 12 for the swing section and setting the target compensation differential pressure of the pressure compensating valve 12A. The fluid chamber 334 (having the pressure bearing area B1>B3) and the fluid chamber 332 (having the pressure bearing area B3) communicating respectively with the signal lines 50*a*, 51*a* of the pressure compensating valve 12A constitute third means provided in at least one 12A of the plurality of pressure compensating valves 12–16, which is for the swing section, and reducing the target compensation differential pressure set by the second means when the load pressure of the swing motor 2 rises, thereby giving a load dependent characteristic to the pressure compensating valve 12A for the swing section. The swing priority spring 55A in the pressure compensating valve 12A constitutes fourth means provided in the pressure compensating valve 12A for the swing section and setting a lower limit of the target compensation differential pressure that is set by the second means and modified by the third means.

Further, in this embodiment, the second means (the fluid chambers 331A, 336) is means for setting, as the target compensation differential pressure, the differential pressure between the delivery pressure of the hydraulic pump 1 and the maximum load pressure among the plurality of actuators 2–6 as with the first means (the fluid chambers 13*a*–16*a*, 13*b*–16*b*). The fourth means (the swing priority spring 55) functions as lower limit setting means for limiting both reduction in the target compensation differential pressure itself set by the second means (the fluid chambers 331A, 336) and reduction in the target compensation differential pressure due to the load dependent characteristic given by the third means (the fluid chambers 332, 334).

Additionally, the fourth means (the swing priority spring 55) is biasing means for always adding a supplement value to the target compensation differential pressure that is set by the second means (the fluid chambers 331A, 336) and modified by the third means (the fluid chambers 332, 334). The directional control valve 7A for the swing section is constructed such that the meter-in variable throttles 57*a*, 57*b* each have the opening area smaller than that in the directional control valves 8–11 not for the swing section by an amount of the target compensation differential pressure corresponding to the supplement value added by the biasing means.

Accordingly, with this embodiment, since the pressure compensating valve 12A for the swing section has the load dependent characteristic, the swing operation can be smoothly accelerated and shifted to the steady state without causing a jerky feel at the start-up in any of swing alone and the combined operation including swing. Also, since the swing priority spring 55A is provided in the pressure compensating valve 12A for the swing section to supply the hydraulic fluid to the swing motor 2 with priority when the delivery rate of the hydraulic pump 1 is in the saturation state, change of the swing speed is suppressed at shift from the swing-alone operation to the swing-combined operation, and so does at reverse shift from the swing-combined operation to the swing-alone operation. Further, at the start-up of the swing-combined operation, the swing speed can be accelerated without being extremely slowed down as compared with the speed of another actuator, whereby superior swing operability and swing independence can be ensured. Additionally, since the above-described functions are achieved without providing a separate circuit, such problems as an increase in cost and space and complication of the circuit configuration are avoided.

A third embodiment of the present invention will be described with reference to FIGS. 15 to 16. In these figures, equivalent members to those shown in FIGS. 1 and 2 are denoted by the same numerals. In this embodiment, a pressure compensating valve for a swing section is given the swing priority without setting the target compensation differential pressure, based on the LS control differential pressure, to the pressure compensating valve for the swing section.

Figure 15:
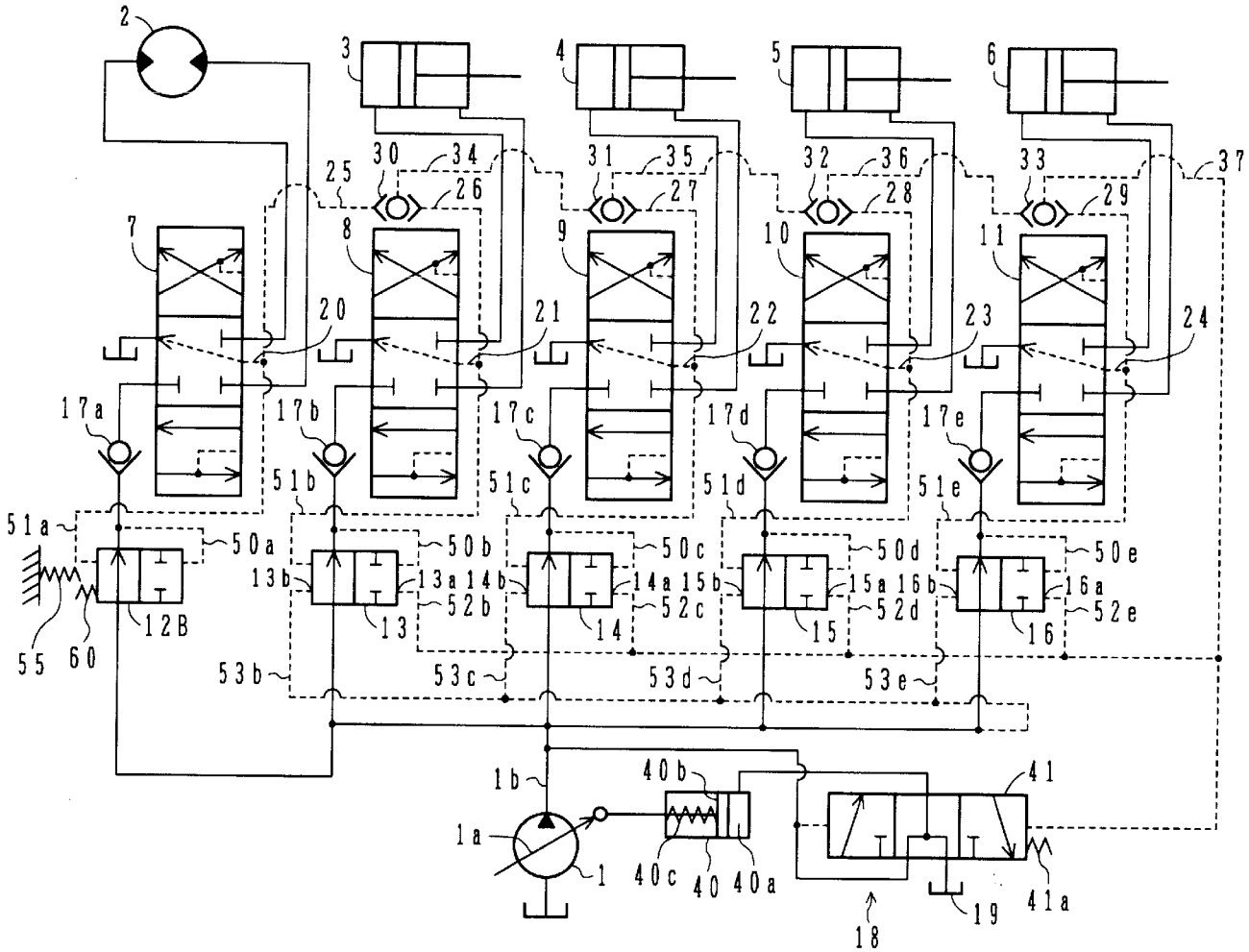
FIG. 15 is a circuit diagram showing a hydraulic drive system according to a third embodiment of the present invention.

Referring to FIG. 15, pressure compensating valves 13–16 for sections other than the swing section are the same as those in the first embodiment.

A pressure compensating valve 12B for the swing section is constructed to have such a load dependent characteristic that when the load pressure of the swing motor 2 rises under a condition where the pressure upstream of the directional control valve 7 acts in the valve-closing direction and the pressure (the load pressure of the swing motor 2) in the detection line 20 given by the pressure downstream of the directional control valve 7 acts in the valve-opening direction, the target compensation differential pressure is reduced to restrict the flow rate of the hydraulic fluid passing the pressure compensating valve 12B. This point is also the same as the pressure compensating valve 12 in the first embodiment.

In addition, the pressure compensating valve 12B includes means, e.g., a setting spring 60, for setting a usual target compensation differential pressure on the side acting in the valve-opening direction, i.e., on the side setting the target compensation differential pressure. The setting spring 60 is selected to set the target compensation differential pressure of the same value as the target compensation differential pressure, which is resulted when the delivery rate of the hydraulic pump 1 is not in the saturation state. In other words, the target compensation differential pressure of the pressure compensating valves 13–16 not for the swing section, in which the target compensation differential pressure is set based on the LS control differential pressure, is reduced depending on the degree of saturation when the delivery rate of the hydraulic pump 1 comes into the saturation state. On the other hand, in the pressure compensating valve 12B for the swing section, the target compensation differential pressure set by the setting spring 60 is essentially unchanged even in the saturation state, and the target compensation differential pressure of the pressure compensating valve 12B is changed in accordance with the load dependent characteristic.

Furthermore, as with the first embodiment, the pressure compensating valve 12B includes a lower limit setting spring 55 for setting a lower limit of the target compensation differential pressure of the pressure compensating valve 12B.

Figure 16:
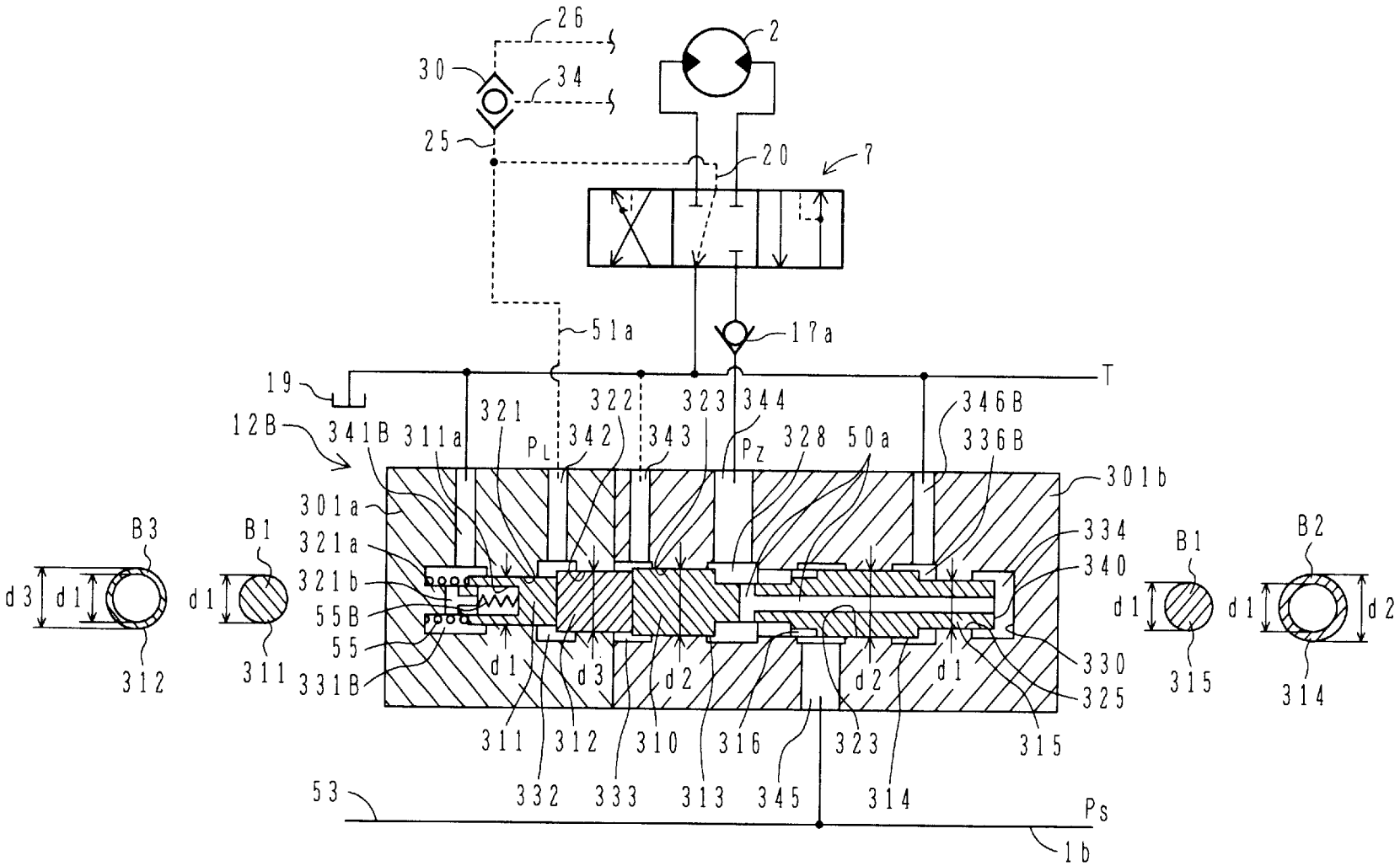
FIG. 16 is a sectional view showing details of the structure of a pressure compensating valve for a swing section.

The structure of the pressure compensating valve 12B is shown in FIG. 16. Referring to FIG. 16, the fluid chambers 331, 336 in the first embodiment, shown in FIG. 2, are replaced respectively by fluid chambers 331B, 336B. These fluid chambers 331B, 336B are communicated with the reservoir through reservoir ports 341B, 346B, respectively, so that a pressure bearing area B1 of the fluid chamber 331B provided by the first spool 311 and a pressure bearing area B2 of the fluid chamber 336B, which is provided by a stepped portion between the second large-diameter portion 314 and the small diameter portion 325 of the third spool 310, will not impose hydraulic forces respectively on the first spool 311 and the third spool 310. Further, in the recess 311*a* formed at the end surface of the first spool 311, the aforesaid spring 60 for setting the target compensation differential pressure is disposed instead of the weak initial-position holding spring 350. The relationship between the pressure bearing areas B3, B1 positioned in the fluid chambers 332, 334 is the same as that in the first embodiment (B1>B3). The pressure compensating valve 12B is thereby given such a load dependent characteristic that the flow rate of the hydraulic fluid passing the directional control valve 7, which is communicated with the swing motor 2, is reduced with an increase in the load pressure (PL) of the swing motor 2.

In the above construction, the fluid chambers 13*a*–16*a*, 13*b*–16*b* communicating with the signal lines 52*b*–52*e*, 53*b*–53*e* of the pressure compensating valves 13–16 constitute first means provided respectively in those 13–16 of the plurality of pressure compensating valves 12–16, which are not for the swing section associated with the swing motor 2, and setting, as the target compensation differential pressure, the differential pressure between the delivery pressure of the hydraulic pump 1 and the maximum load pressure among the plurality of actuators 2–6. The setting spring 60 in the pressure compensating valve 12B constitutes second means provided in the pressure compensating valve 12B for the swing section and setting the target compensation differential pressure of the pressure compensating valve 12B. The fluid chamber 334 (having the pressure bearing area B1>B3) and the fluid chamber 332 (having the pressure bearing area B3) communicating respectively with the signal lines 50*a*, 51*a* of the pressure compensating valve 12B constitute third means provided in at least one 12B of the plurality of pressure compensating valves 12–16, which is for the swing section, and reducing the target compensation differential pressure set by the second means when the load pressure of the swing motor 2 rises, thereby giving a load dependent characteristic to the pressure compensating valve 12B for the swing section. The lower limit setting spring 55 in the pressure compensating valve 12 constitutes fourth means provided in the pressure compensating valve 12 for the swing section and setting a lower limit of the target compensation differential pressure that is set by the second means and modified by the third means.

Further, in this embodiment, the second means (the setting spring 60) is means for setting, as the target compensation differential pressure, a value not changed depending on the differential pressure between the delivery pressure of the hydraulic pump 1 and the maximum load pressure among the plurality of actuators 2–6. The fourth means (the lower limit setting spring 55 ) functions as lower limit setting means for limiting reduction in the target compensation differential pressure due to the load dependent characteristic given by the third means (the fluid chambers 332, 334).

Additionally, the fourth means (the lower limit setting spring 55) is biasing means for applying a biasing force to the spool 311 of the pressure compensating valve 12B for the swing section in the valve-opening direction when the target compensation differential pressure set by the second means (the setting spring 60) and modified by the third means (the fluid chambers 332, 334) reaches a predetermined value.

In this embodiment thus constructed, the setting spring 60 is selected to set the target compensation differential pressure of the same value as the target compensation differential pressure given by the LS control differential pressure, which is resulted when the delivery rate of the hydraulic pump 1 is not in the saturation state. Prior to the delivery rate of the hydraulic pump 1 coming into the saturation state, therefore, the target compensation differential pressure is set to distribute the delivery rate of the hydraulic pump 1 at the ratio between the respective demanded flow rates of the plural actuators, and the target compensation differential pressure is modified by the load dependent characteristic of the pressure compensating valve 12 for the swing section, as with the first embodiment. On the other hand, when the delivery rate of the hydraulic pump 1 comes into the saturation state, the target compensation differential pressure of the pressure compensating valves 13–16 not for the swing section is reduced with a lowering of the LS control differential pressure, whereas the target compensation differential pressure of the pressure compensating valve 12B for the swing section, which is set by the setting spring 60, is not changed depending on the degree of saturation, but changed only in accordance with the load dependent characteristic. Further, the lower limit setting spring 55 functions to limit the reduction in the target compensation differential pressure due to the load dependent characteristic. Hence, as with the first and second embodiments, the hydraulic fluid is thereby supplied to the swing motor 2 with priority.

Accordingly, with this embodiment, since the pressure compensating valve 12B for the swing section has the load dependent characteristic, the swing operation can be smoothly accelerated and shifted to the steady state without causing a jerky feel at the start-up in any of swing alone and the combined operation including swing. Also, since the lower limit setting spring 55 and the setting spring 60 are provided in the pressure compensating valve 12B for the swing section to supply the hydraulic fluid to the swing motor 2 with priority when the delivery rate of the hydraulic pump 1 is in the saturation state and the target compensation differential pressure is reduced in accordance with the load dependent characteristic, change of the swing speed is suppressed at shift from the swing-alone operation to the swing-combined operation, and so does at reverse shift from the swing-combined operation to the swing-alone operation. Further, at the start-up of the swing-combined operation, the swing speed can be accelerated without being extremely slowed down as compared with the speed of another actuator, whereby superior swing operability and swing independence can be ensured. Additionally, since the above-described functions are achieved without providing a separate circuit, such problems as an increase in cost and space and complication of the circuit configuration are avoided.

While each of the above embodiments employs, by way of example, a before-orifice type pressure compensating valve which is positioned upstream of a directional control valve, a system having the same advantage can also be constructed by using an after-orifice type pressure compensating valve which is positioned downstream of a directional control valve.

Also, in the above embodiments, the lower limit setting spring 55, the swing priority spring 55A, and the setting spring 60 are provided as means for controlling the target compensation differential pressure so that the pressure compensating valve for the swing section is given priority. However, hydraulic control forces may be applied to fluid chambers for receiving control pressures, these fluid chambers being formed similarly to the fluid chambers to which the pressures upstream and downstream of the directional control valve are introduced. In this case, more sophisticated and advantageous control can be performed by changing the control pressures in accordance with the intended purpose.

Further, in each of the above embodiments, the differential pressure between the delivery pressure of the hydraulic pump and the maximum load pressure among the plurality of actuators is set, as the target compensation differential pressure, by introducing the pump delivery pressure and the maximum load pressure to opposite ends of the spool of the pressure compensating valve. However, the arrangement may be modified such that a differential pressure generating valve for generating a secondary pressure corresponding to the differential pressure between the delivery pressure of the hydraulic pump and the maximum load pressure among the plurality of actuators is provided and an output pressure of the differential pressure generating valve is introduced to one end of the spool of the pressure compensating valve, which acts in the valve-opening direction.

INDUSTRIAL APPLICABILITY

According to the present invention, in a hydraulic drive system including a swing control system, the swing operation can be smoothly accelerated and shifted to the steady state without causing a jerky feel at the start-up in any of swing alone and the combined operation including swing. Also, change of the swing speed is suppressed at shift from the swing-alone operation to the swing-combined operation, and vice versa. Further, at the start-up of the swing-combined operation, the swing speed can be accelerated without being extremely slowed down as compared with the speed of another actuator, whereby superior swing operability and swing independence can be ensured. Additionally, a system can be realized which is free from the problems caused by providing a separate circuit, such as an increase in cost and space and complication of the circuit configuration.

What is claimed is:

1. A hydraulic drive system comprising a hydraulic pump, a plurality of actuators, including a swing motor, which are driven by a hydraulic fluid delivered from said hydraulic pump, a plurality of directional control valves for controlling respective flow rates of the hydraulic fluid supplied from said hydraulic pump to said plurality of actuators, a plurality of pressure compensating valves for controlling respective differential pressures across said plurality of directional control valves, and pump control means for load sensing control to control a pump delivery rate such that a delivery pressure of said hydraulic pump is held a predetermined value higher than a maximum load pressure among said plurality of actuators, wherein said hydraulic drive system further comprises:

first means provided respectively in those of said plurality of pressure compensating valves, which are not for a swing section associated with said swing motor, and setting, as a target compensation differential pressure, a differential pressure between the delivery pressure of said hydraulic pump and the maximum load pressure among said plurality of actuators, second means provided in the pressure compensating valve for the swing section and setting a target compensation differential pressure of the pressure compensating valve, third means provided in at least one of said plurality of pressure compensating valves, which is for the swing section, and reducing the target compensation differential pressure set by said second means when a load pressure of said swing motor rises, thereby giving a load dependent characteristic to the pressure compensating valve for the swing section, and fourth means provided in the pressure compensating valve for the swing section and setting a lower limit of the target compensation differential pressure that is set by said second means and modified by said third means.

2. A hydraulic drive system according to claim 1, wherein said second means is means for setting, as the target compensation differential pressure, the differential pressure between the delivery pressure of said hydraulic pump and the maximum load pressure among said plurality of actuators as with said first means, and said fourth means functions as lower limit setting means for limiting both reduction in the target compensation differential pressure itself set by said second means and reduction in the target compensation differential pressure due to the load dependent characteristic given by said third means.

3. A hydraulic drive system according to claim 1, wherein said fourth means is biasing means for applying a biasing force to a spool of the pressure compensating valve for the swing section in the valve-opening direction when the target compensation differential pressure set by said second means and modified by said third means reaches a predetermined value.

4. A hydraulic drive system according to claim 3, wherein said biasing means is biasing means for applying a biasing force to a spool of the pressure compensating valve for the swing section in the valve-opening direction when the target compensation differential pressure set by said second means and modified by said third means reaches a predetermined value.

5. A hydraulic drive system according to claim 1, wherein said pressure compensating valve (12) for the swing section comprises a spool and a weak spring (350) for holding the spool in an initial-position and said fourth means (55) is provided separately from said spring.

6. A hydraulic drive system comprising a hydraulic pump, a plurality of actuators, including a swing motor, which are driven by a hydraulic fluid delivered from said hydraulic pump, a plurality of directional control valves for controlling respective flow rates of the hydraulic fluid supplied from said hydraulic pump to said plurality of actuators, a plurality of pressure compensating valves for controlling respective differential pressures across said plurality of directional control valves, and pump control means for load sensing control to control a pump delivery rate such that a delivery pressure of said hydraulic pump is held a predetermined value higher than a maximum load pressure among said plurality of actuators, wherein said hydraulic drive system further comprises:

first means provided respectively in those of said plurality of pressure compensating valves, which are not for a swing section associated with said swing motor, and setting, as a target compensation differential pressure, a differential pressure between the delivery pressure of said hydraulic pump and the maximum load pressure among said plurality of actuators, second means provided in the pressure compensating valve for the swing section and setting a target compensation differential pressure of the pressure compensating valve, third means provided in at least one of said plurality of pressure compensating valves, which is for the swing section, and reducing the target compensation differential pressure set by said second means when a load pressure of said swing motor rises, thereby giving a load dependent characteristic to the pressure compensating valve for the swing section, and fourth means provided in the pressure compensating valve for the swing section and setting a lower limit of the target compensation differential pressure that is set by said second means and modified by said third means; and wherein said second means is means for setting, as the target compensation differential pressure, a value not changed depending on the differential pressure between the delivery pressure of said hydraulic pump and the maximum load pressure among said plurality of actuators, and said fourth means functions as lower limit setting means for limiting reduction in the target compensation differential pressure due to the load dependent characteristic given by said third means.

7. A hydraulic drive system comprising a hydraulic pump, a plurality of actuators, including a swing motor, which are driven by a hydraulic fluid delivered from said hydraulic pump, a plurality of directional control valves for controlling respective flow rates of the hydraulic fluid supplied from said hydraulic pump to said plurality of actuators, a plurality of pressure compensating valves for controlling respective differential pressures across said plurality of directional control valves, and pump control means for load sensing control to control a pump delivery rate such that a delivery pressure of said hydraulic pump is held a predetermined value higher than a maximum load pressure among said plurality of actuators, wherein said hydraulic drive system further comprises:

first means provided respectively in those of said plurality of pressure compensating valves, which are not for a swing section associated with said swing motor, and setting, as a target compensation differential pressure, a differential pressure between the delivery pressure of said hydraulic pump and the maximum load pressure among said plurality of actuators, second means provided in the pressure compensating valve for the swing section and setting a target compensation differential pressure of the pressure compensating valve, third means provided in at least one of said plurality of pressure compensating valves, which is for the swing section, and reducing the target compensation differential pressure set by said second means when a load pressure of said swing motor rises, thereby giving a load dependent characteristic to the pressure compensating valve for the swing section, and fourth means provided in the pressure compensating valve for the swing section and setting a lower limit of the target compensation differential pressure that is set by said second means and modified by said third means; and wherein said fourth means is biasing means for always adding a supplement value to the target compensation differential pressure that is set by said second means and modified by said third means, and the directional control valve for the swing section is constructed such that meter-in variable throttles thereof each have an opening area smaller than that in the directional control valves not for the swing section by an amount of the target compensation differential pressure corresponding to the supplement value added by said biasing means.

8. A hydraulic drive system according to claim 7, wherein said biasing means is a swing priority spring always acting on said spool of the pressure compensating valve for the swing section in the valve-opening direction.

* * * * *